US010487494B1

(12) United States Patent
Roberts et al.

(10) Patent No.: US 10,487,494 B1
(45) Date of Patent: Nov. 26, 2019

(54) ARCHITECTURAL BUILDING BLOCK SYSTEM

(71) Applicant: Spherical Block LLC, Alfred Station, NY (US)

(72) Inventors: Peter Andrew Roberts, Alfred Station, NY (US); Ryan Hall, Rhinebeck, NY (US); Isis Cable, Rochester, NY (US); Nolan Kramer, Holland, NY (US); Steven Lock, Silver Creek, NY (US); Jared Mason, Jamaica, NY (US); Naqib Shahan, Jamaica, NY (US); Nicholas Risley, Brocton, NY (US); Eric Chindamo, Auburn, NY (US); Sara Perez, NY, NY (US); Tyler Miller, Hornell, NY (US); Patrick Palmer, Alfred Station, NY (US)

(73) Assignee: Spherical Block LLC, Alfred Station, NY (US)

( * ) Notice: Subject to any disclaimer, the term of this patent is extended or adjusted under 35 U.S.C. 154(b) by 0 days.

(21) Appl. No.: 16/292,903

(22) Filed: Mar. 5, 2019

(51) Int. Cl.

| | |
|---|---|
| ***E04B 1/32*** | (2006.01) |
| ***E04B 5/00*** | (2006.01) |
| ***E04B 1/76*** | (2006.01) |
| ***E04C 1/42*** | (2006.01) |

(52) U.S. Cl.
CPC ..... *E04B 1/32* (2013.01); *E04B 1/7604* (2013.01); *E04C 1/24* (2013.01); *E04C 1/42* (2013.01); *E04B 2001/3241* (2013.01); *E04B 2001/3252* (2013.01); *E04B 2001/3288* (2013.01)

(58) Field of Classification Search
CPC .. E04B 1/32; E04B 1/7604; E04B 2001/3288; E04B 2001/3252; E04B 2001/3241; E04C 1/42; E04C 1/24
See application file for complete search history.

(56) References Cited

U.S. PATENT DOCUMENTS

| | | | | |
|---|---|---|---|---|
| 834,950 | A * | 11/1906 | Van Wie | E04F 15/04 52/589.1 |
| 2,392,551 | A | 1/1946 | Roe | |
| 2,653,450 | A * | 9/1953 | Fort | E02D 29/0266 405/287 |
| 2,892,340 | A * | 6/1959 | Fort | E04B 2/22 52/223.7 |
| 3,255,556 | A * | 6/1966 | Amato | E04B 1/3211 52/81.4 |

(Continued)

FOREIGN PATENT DOCUMENTS

WO WO-9920860 A1 * 4/1999 ..... E04B 1/3205

*Primary Examiner* — Rodney Mintz
(74) *Attorney, Agent, or Firm* — Tracy Jong Law Firm; Tracy P. Jong; Cheng Ning Jong

(57) ABSTRACT

An architectural building block system including a block having three side walls, each having an inside surface and an outside surface, the three side walls cooperate to form a triangular tube, the outside surface of each of the three side walls extending from the inner surface to the outer surface and the inside surface of each of the three walls is disposed substantially at right angle to each of the inner surface and the outer surface; and three channels, each channel disposed on one of the three side walls on the inner surface, wherein each channel extending from the inside surface to the outside surface of one of the three side walls and each pair of the three channels configured to receive a rebar.

18 Claims, 27 Drawing Sheets

(56) References Cited

U.S. PATENT DOCUMENTS

| | | | | | |
|---|---|---|---|---|---|
| 4,505,088 | A * | 3/1985 | Lippe | E04B 1/3205 | 249/24 |
| 4,611,441 | A * | 9/1986 | Wickens | E04B 1/3211 | 52/81.4 |
| 4,644,710 | A * | 2/1987 | Lippe | E04B 1/3205 | 52/223.7 |
| 5,261,194 | A * | 11/1993 | Roberts | E04B 1/3211 | 52/285.1 |
| 5,329,737 | A * | 7/1994 | Roberts | E04B 1/3211 | 52/245 |
| 5,560,151 | A * | 10/1996 | Roberts | E04B 1/3205 | 52/245 |
| 5,732,518 | A * | 3/1998 | Roberts | E04B 1/3205 | 52/245 |
| 5,873,206 | A * | 2/1999 | Roberts | E04B 1/3205 | 52/245 |
| 6,076,318 | A * | 6/2000 | Grimm | E04B 1/3205 | 426/122 |
| 6,477,814 | B1 * | 11/2002 | Kadosh | E02D 29/025 | 405/284 |
| 8,567,149 | B2 * | 10/2013 | Kuzmin | A63H 33/08 | 52/592.1 |
| 9,133,619 | B1 * | 9/2015 | Roberts | E04C 1/00 | |
| 9,809,971 | B2 * | 11/2017 | Roberts | E04B 1/3211 | |
| 10,036,161 | B1 | 7/2018 | Roberts et al. | | |
| 2009/0117311 | A1 * | 5/2009 | Kuzmin | A63H 33/08 | 428/44 |
| 2010/0050558 | A1 * | 3/2010 | Roberts | E02B 3/04 | 52/653.2 |
| 2013/0205705 | A1 | 8/2013 | Bilka | | |
| 2017/0247874 | A1 * | 8/2017 | Roberts | E04B 1/3211 | |
| 2018/0334800 | A1 * | 11/2018 | Swank | E04H 17/1404 | |

* cited by examiner

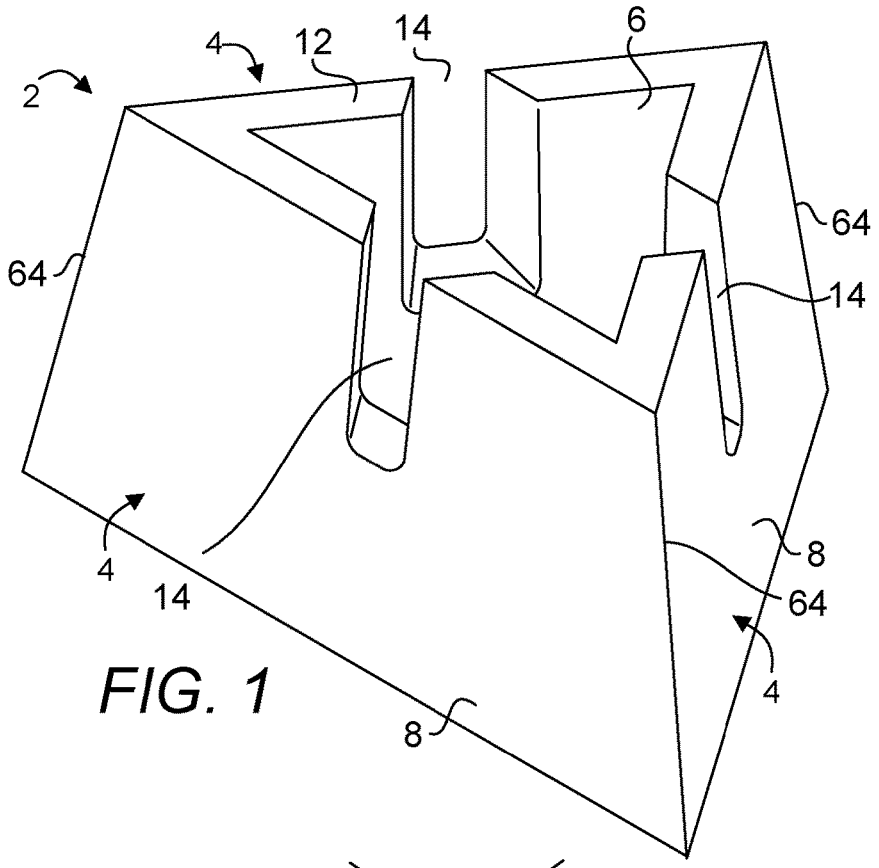
FIG. 1
FIG. 2
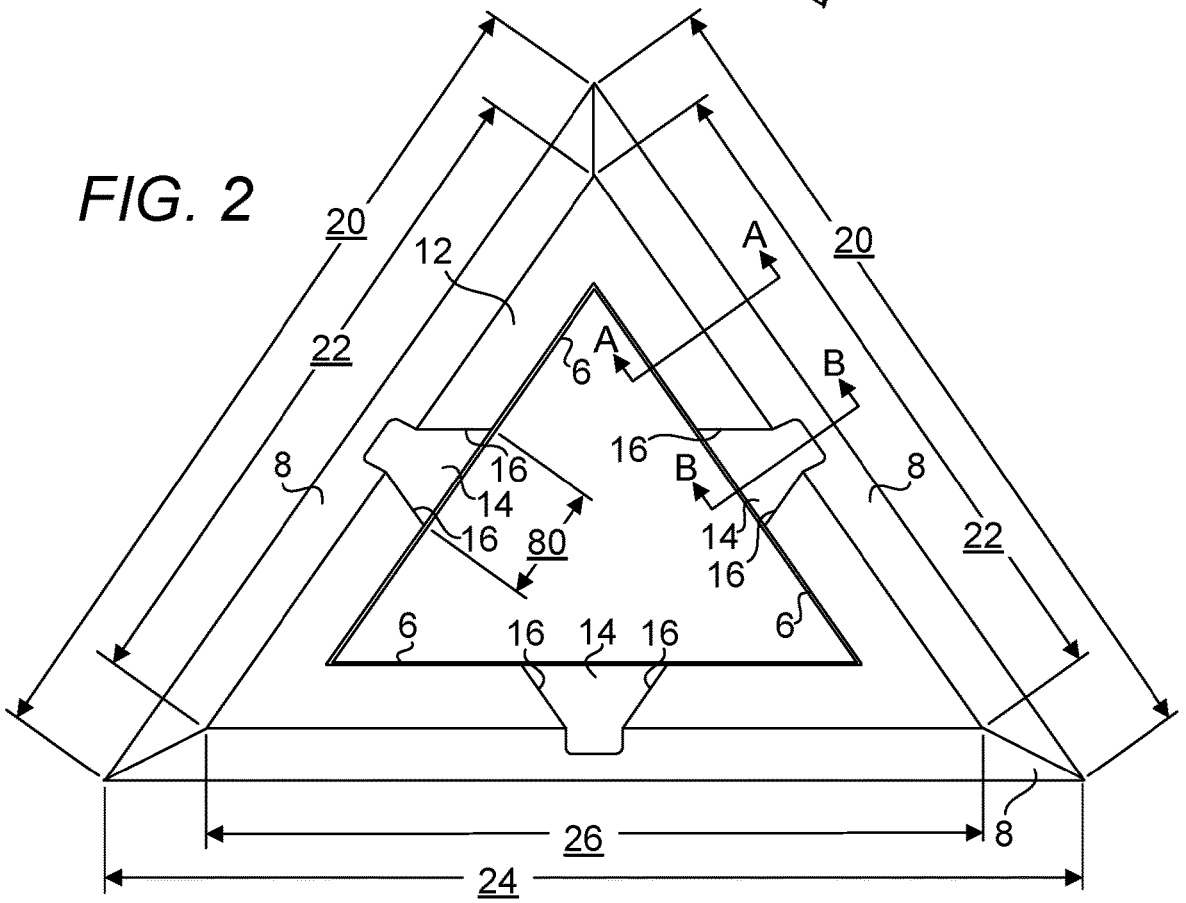

FIG. 12
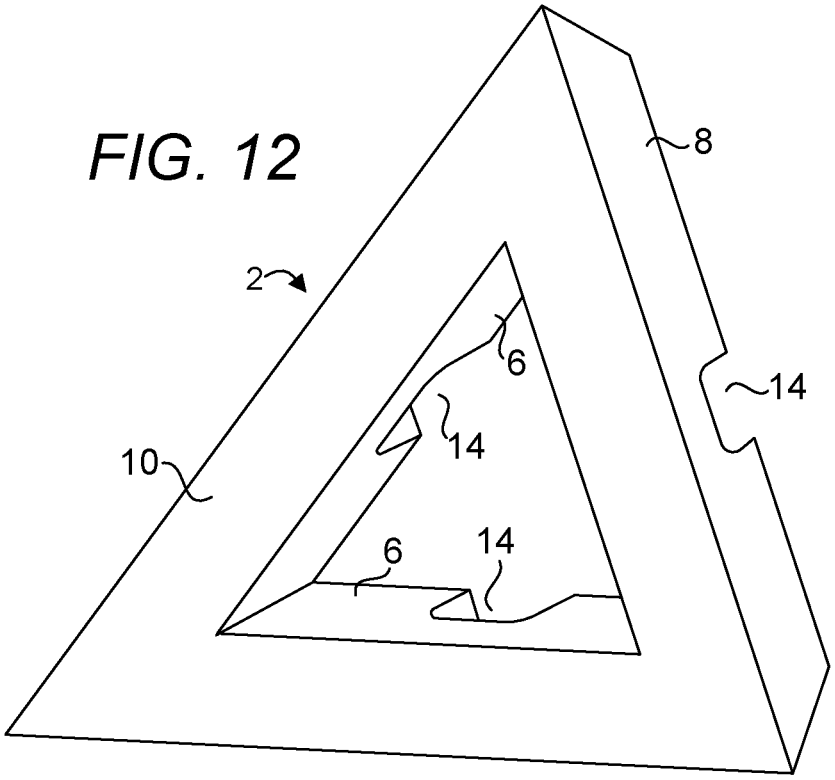
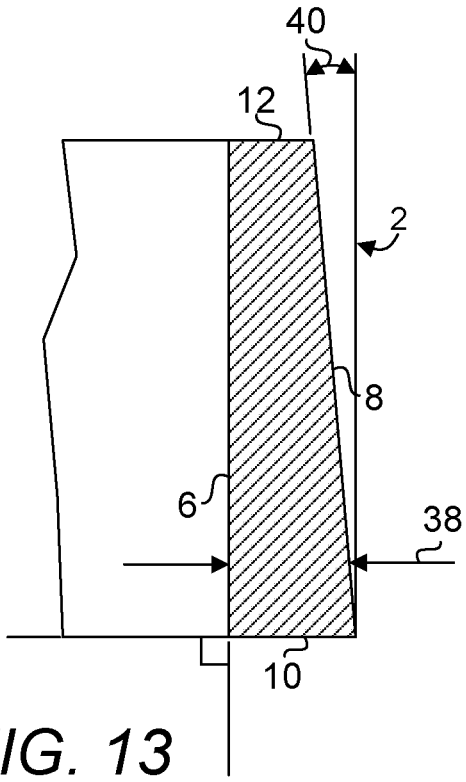
FIG. 13
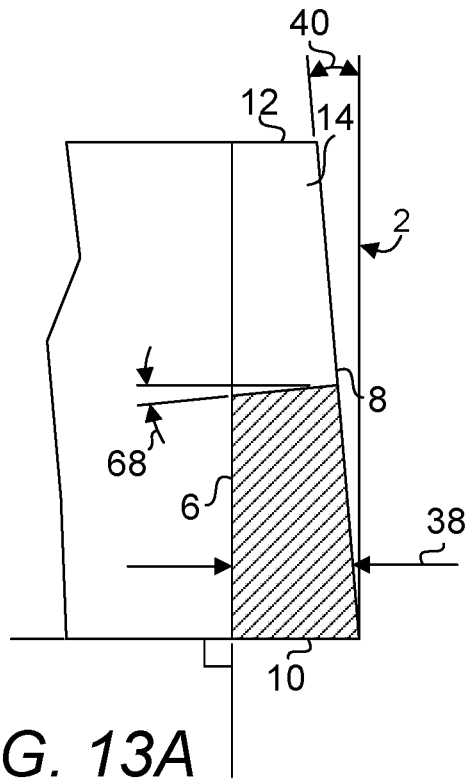
FIG. 13A

ARCHITECTURAL BUILDING BLOCK SYSTEM

BACKGROUND OF THE INVENTION

1. The Field of the Invention

The present invention is directed generally to architectural building blocks for constructing spheres or spherical domes. More specifically, the present invention is directed to masonry architectural building blocks for constructing spheres or spherical domes.

2. Background Art

In fabricating structures composed of curvilinear parts, typically forms are required for concrete pouring as conventional blocks are often unsuitable for constructing such parts as conventional masonry blocks are unsuitable due to their shapes and sizes. On-site constructions of structures using forms often involve significant custom architectural and engineering preparation work, which not only increases the construction cost but also the lead time in completing the construction projects. Even if conventional masonry blocks are used to construct curvilinear parts, sufficient skills are required to custom shape some masonry blocks so that they can fit in with other unmodified blocks to approximate the structural shape to be constructed. Conventional blocks used for curvilinear parts include rectangular and triangular blocks, etc. In many occasions, sufficient skills may also be required to adjust the amount of mortar used or the configuration of the gasket between blocks such that curvilinear parts can be constructed. When built without forms or other supporting structures, the use of conventional blocks does not yield uniform, accurate and repeatable curvilinear parts, e.g., cylinders and arches, let alone spheres and spherical domes. It may even be impossible to construct a curvilinear structure using conventional blocks if mortar or gasket had not been used.

U.S. Pat. No. 2,392,551 to Roe (hereinafter Roe) discloses a wall structure having a series of superposed courses of building blocks, matching keyways in certain adjacent blocks in a course and keys in the keyways locking the adjacent blocks together. Each of the keys extends from one course into and fits snugly within an opening in a block of an adjacent course, thereby locking adjacent courses together against horizontal shifting, and tongue and groove connections inclined to the longitudinal axes of the keys and interlocking blocks of adjacent courses whereby the first named keys and the tongue and groove connections lock the courses against vertical as well as horizontal shifting, the tongues of the tongue and groove connections being each integral with a block. Although a means for interlocking adjacently disposed blocks is provided, Roe fails to disclose building blocks useful for building spheres or spherical domes.

U.S. Pat. Pub. No. 2013/0205705 of Bilka (hereinafter Bilka) discloses a masonry article having one or more side walls, top and bottom, and first and second ends configured with a horizontal and vertical locking mechanism, wherein top and bottom includes first axis locking mechanism, wherein the top surface is formed with at least one stepped section having a base that begins with a level footing and the bottom opposite surface formed with at least one other stepped section having a base that begins with a level footing to releasably receive one of the top, and wherein first and second ends include contoured receptacles to releasably receive a matching configured link block having opposite male contour surface to form second axis locking mechanism. Similar to Roe, Bilka fails to disclose building blocks useful for building spheres and spherical domes.

U.S. Pat. No. 10,036,161 to Roberts et al. (hereinafter Roberts) discloses an architectural building block system including a block having three side walls, each having an inside surface and an outside surface, the three side walls cooperate to form a triangular tube having three corners, the outside surface of each of the three side walls extending outwardly from the inner surface to the outer surface and the inside surface of each of the three walls is disposed substantially at right angle to each of the inner surface and the outer surface; and three channel pairs, each configured to receive a rebar, each channel pair including a first channel disposed on one of the three side walls on the inner surface and a second channel disposed on a corner of the three corners that is opposingly disposed from one of the three side walls. Roberts' blocks are not configured to accommodate long continuous rebars and are suitable for construction techniques where rebars are installed incrementally.

Thus, there is a need for blocks useful for constructing spheres and spherical domes that are capable of resisting environmental forces and ones which can be built without using pre-fabricated or in-situ built forms and temporary support structures or scaffolding systems and blocks that can be coupled or used in conjunction with long continuous rebars.

SUMMARY OF THE INVENTION

In accordance with the present invention, there is provided an architectural building block system including:

(a) three side walls, each having an inside surface and an outside surface, the three side walls cooperate to form a triangular tube, the outside surface of each of the three side walls extending from an inner surface to an outer surface and the inside surface of each of the three walls is disposed substantially at right angle to each of the inner surface and the outer surface; and (b) three channels, each channel disposed on one of the three side walls on the inner surface, wherein each channel extending from the inside surface to the outside surface of one of the three side walls and each pair of the three channels configured to receive a rebar, wherein at least one of the side walls is configured to be positionable so as to mate with a side wall of an adjacently disposed block to form two aligned channels to receive the rebar, whereby curved structures may be constructed from a plurality of such blocks to form a dihedral angle between each set of two blocks.

In one embodiment, each of the three side walls extends outwardly from the inner surface to the outer surface.

In one embodiment, each channel converges as it extends from the inside surface to the outside surface of each side wall.

In one embodiment, the dihedral angle ranges from about 0.5 degree to about 12 degrees.

In one embodiment, the block system further includes a cladding configured to be disposed on the outer surface of the block, wherein the cladding is configured to plug a cross-sectional area of an opening of the triangular tube.

In one embodiment, the block system further includes an anchor configured to connect the cladding to the rebar to secure the rebar in place.

In one embodiment, the cladding includes an insulating material.

In one embodiment, the anchor is a wire, ziptie, string, strap, hook and loop-equipped strap, bolt, rubber band, snap-equipped strap or any combinations thereof.

In one embodiment, the block system further includes an anchor configured to secure the rebar to the outer surface, the anchor having a first end configured to be attached to the rebar and a second end configured to be secured to the outer surface.

In one embodiment, the block system further includes an anchor having two ends, a first end of the two ends is configured to be connected to the rebar within an opening of the tube of the block and a second end of the two ends is configured to be connected to the rebar via the outer surface within an opening of a triangular tube of the adjacently disposed block.

A present architectural building block may be constructed from concrete, cinders, vitrified ceramic, glass, plastic, wood pulp, cardboard, fiberglass, epoxy composite, metal, construction foam, tamped earth, boron, borides, or any combinations thereof.

An object of the present invention is to provide a block capable of assembly with similar blocks to form spheres and spherical domes.

Another object of the present invention is to provide a block capable of assembly with similar blocks with or without mortar.

Another object of the present invention is to provide a block capable of assembly with similar blocks with tensile elements.

Another object of the present invention is to provide a block capable of assembly with similar blocks with long continuous tensile elements.

Another object of the present invention is to provide a block that is orientation agnostic. Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 1 is a top front perspective view of one embodiment of a block.

FIG. 2 is a top plan view of the block thereof.

FIG. 12 is a bottom perspective view of the block thereof.

FIG. 13 is a sectional view of a side wall of the block as taken along line A-A of FIG. 2.

FIG. 13A is a sectional view of a side wall of the block as taken along line B-B of FIG. 2.

PARTS LIST

Figure 3:
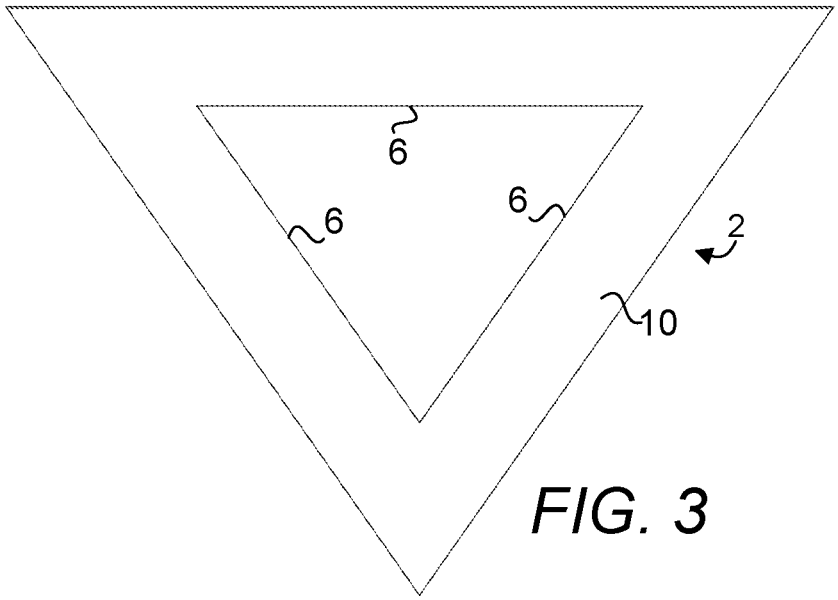
FIG. 3 is a bottom plan view of the block thereof.

2—architectural building block
4—side wall
6—inside surface of side wall
8—outside surface of side wall
10—outer surface
12—inner surface
14—channel
16—side wall of channel
18—rebar or tensile element
20—length of outside surface of an equal side wall of pentagonal block at outer surface
22—length of outside surface of an equal side wall of pentagonal block at inner surface
24—length of outside surface of a unique side wall of pentagonal block at outer surface
26—length of outside surface of a unique side wall of pentagonal block at inner surface
28—height of block
30—length of outside surface of an equal side wall of hexagonal block at outer surface
32—length of outside surface of an equal side wall of hexagonal block at inner surface
34—length of outside surface of a unique side wall of hexagonal block at outer surface
36—length of outside surface of a unique side wall of hexagonal block at inner surface
38—thickness of side wall
40—dihedral angle
42—angle made between side walls of two coupled blocks
44—mortar or gasket
46—hexagonal group of blocks
48—pentagonal group of blocks
50—anchor
52—protrusion
54—nut
56—bolt
58—protrusion
60—cladding
62—fastener
64—corner
66—edge
68—angle of incline of channel bottom
70—arrangement
72—arrangement
74—arrangement
76—arrangement
78—protrusion
80—width of channel on inside surface of side wall
82—width of channel on outside surface of side wall
84—depth of channel
86—edge of pentagonal block
88—edge of hexagonal block Particular Advantages of the Invention A plurality of the present blocks can be used not only to build flat surfaces, e.g., when their outer and inner surfaces are co-planarly aligned, but also spheres and spherical domes, etc. As such, this provides design flexibility in the types of structures that may result from the use of such blocks or the types of structures that result from the use of only rectangular blocks.

Structures, e.g., spheres and spherical domes, that are formed as a result of the use of the present blocks can include tensile elements, e.g., rebars, steel, Kevlar® or carbon fiber cables, resulting in greater flexural rigidity and overall strength in the structures. Such structures present greater resistance to external loading, impacts, high winds, seismic forces, etc.

Insulating materials and/or coverings can be easily secured as the claddings that are used on the outer surface of each block can be positively secured against rebars which also serve to strengthen any structures built with such blocks.

A plurality of present blocks can be formed at once on each pallet of a conventional block manufacturing machine, making the process of forming such blocks as economically feasible as those of ubiquitous rectangular blocks. Further, in one embodiment, the present blocks are dimensioned to correspond to the modular coordination of design used in U.S. construction, where all materials are based on 4 inch cubic grid. In one embodiment, each present block measures about 16 inches (side wall length 24 of FIG. 2) by about 13.9 inches (side wall length 20 of FIG. 2) by about 8 inches (side wall height 28), i.e., dimensions that are similar to the ubiquitous concrete blocks used in the U.S. construction industry. In another embodiment, each present block measures about 16 inches (side wall length 34 of FIG. 15) by about 12.7 inches (side wall length 36 of FIG. 15) by about 8 inches (side wall height), i.e., dimensions that are similar to the ubiquitous concrete blocks used in the U.S. construction industry. These dimensions allow for a maximum number of blocks to be made per cycle on an existing block machine; a feature which is very important to mold life and throughput for a block manufacturer. This high throughput results in low cost and high performance structures.

In forming a sphere, continuous rebars only need to be arranged in great circle arcs before the present blocks can be coupled to the rebars. In assembling the present blocks with the rebars, the rebars need not be cut into short lengths, removing the need for incrementally forming parts of a sphere or dome to eventually complete the sphere or dome. The sphere or dome can be built expediently by first arranging rebars in the form desired before coupling blocks to the rebars to form the sphere or dome. In Roberts, rebars of three different lengths are required, i.e., those for use with pentagonal-hexagonal, pentagonal-pentagonal and hexagonal-hexagonal arrangements, increasing the costs associated with preparing and installing the rebars. Further, when three different lengths of rebars are used on one block, these rebars cross in the center of the block and form an overlap of three rebars which should be tied together to secure the rebars. Therefore one of the three rebars involved in the overlap is adversely removed from its intended anchor positions due to the overlap. Conversely, the present block system allows rebars to cross at channels disposed at side walls. At most, there are overlaps of only two rebars as compared to Roberts. Further, the present block system does not require the rebars to be positively tied in order to secure them.

In Roberts, a rebar is required to be fastened to the outer surface of a block, to keep the block from falling in. In the present block system, no such fastening is required as the block simply rests on the framework of continuous rebars.

In the present block system, no corner channels are required on each block, making the fabrication of the present blocks easier and with shorter cycle times.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Disclosed herein are embodiments of an architectural building block for construction of spheres or spherical domes. FIGS. 1-13 disclose one embodiment of the present block individually. FIGS. 14-23 disclose another embodiment of the present block individually. A present architectural building block 2 is a generally triangular block having an outer surface 10, an inner surface 12 disposed in substantially parallel configuration with respect to the outer surface 10 and three side walls 4, each adjoining the outer surface 10 and the inner surface 12. Although a plurality of blocks of each embodiment shown in FIG. 1-13 and FIG. 14-23 is capable for use in constructing a curved surface, the combination of these two types of blocks is preferable for use in construction of a Goldberg polyhedron as disclosed elsewhere herein, with blocks of the type shown in FIGS. 1-13 configured to form one or more pentagonal groups of blocks and blocks of the type shown in FIGS. 14-23 configured to form one or more hexagonal groups of blocks. For the sake of clarity, the block shown in FIGS. 1-13 will be referred to as a "pentagonal" block and the block shown in FIGS. 14-23 is referred to as a "hexagonal" block. The inner surface 12 or outer surface 10 of either the pentagonal or hexagonal to block is essentially shaped as an isosceles, i.e., two of its sides are of equal lengths and the remaining side is of a unique length. Each side wall 4 includes an inside surface 6 and an outside surface 8. Each side wall 4 extends from an inner surface 12 to an outer surface 10. The three side walls are arranged in such a way to cooperate to form a triangular tube having three corners 64. In the embodiments shown in FIGS. 1-40, the outside surface 8 of each of the three side walls extend outwardly from the inner surface 12 to the outer surface 10 and the inside surface 6 of each of the three walls is disposed substantially at right angle to each of the inner surface 12 and the outer surface 10.

There is provided three channels, each channel 14 disposed on one of the three side walls 4 on the inner surface 12, wherein each channel 14 extending from the inside surface 12 to the outside surface 10 of one of the three side walls 4 and each pair of the three channels 14 configured to receive a rebar. A side wall 4 is configured to be positionable so as to mate with a side wall 4 of an adjacently disposed block 2 to form two aligned channels 14 as shown in FIGS. 34-37 such that curved structures may be constructed from a plurality of such blocks to form a dihedral angle between each set of two blocks as shown in FIGS. 24-27.

Figure 4:
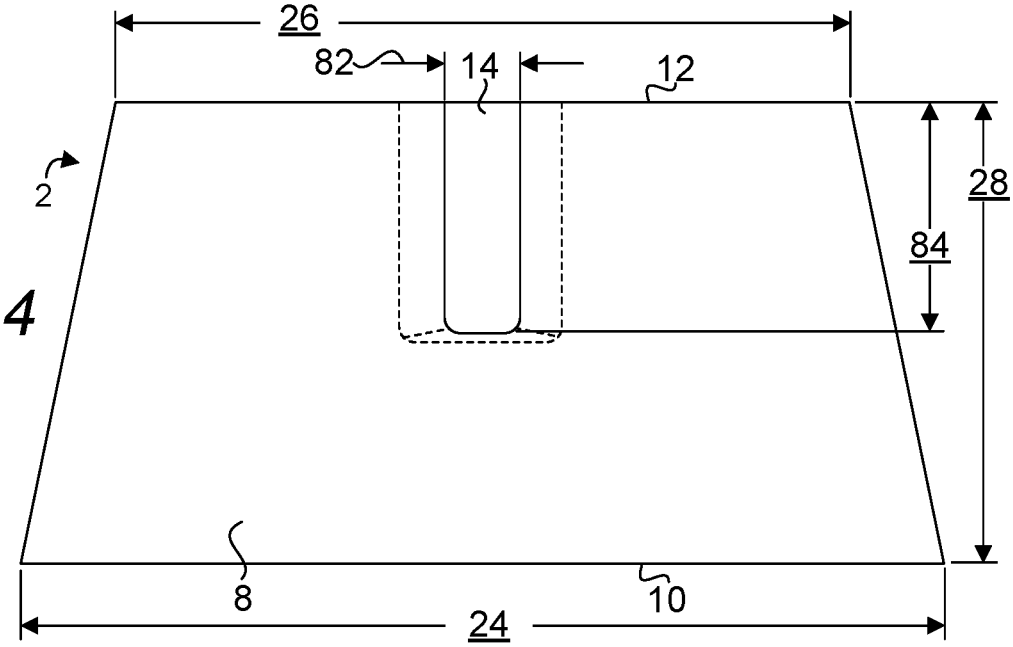
FIG. 4 is a front orthogonal view of a side wall of the block thereof.
Figure 5:
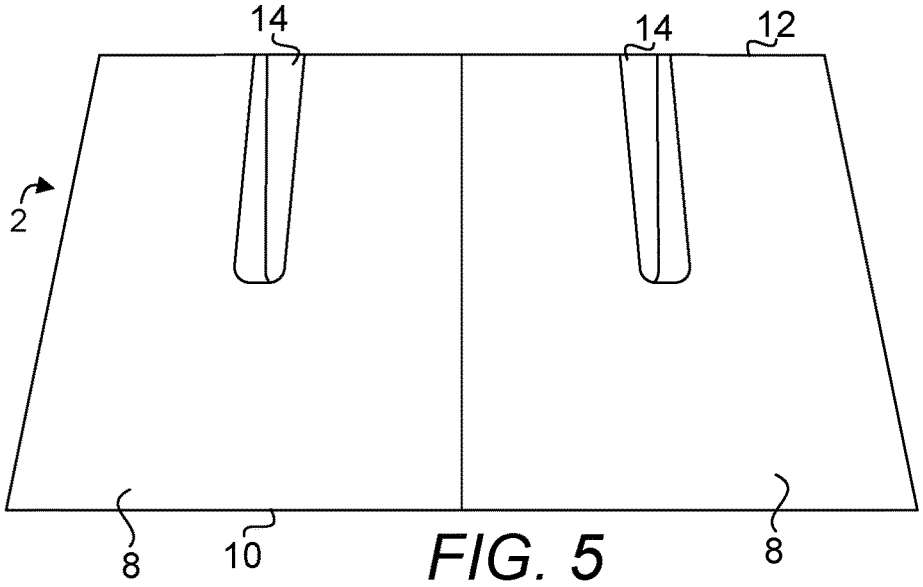
FIG. 5 is a rear view of the block thereof.
Figure 6:
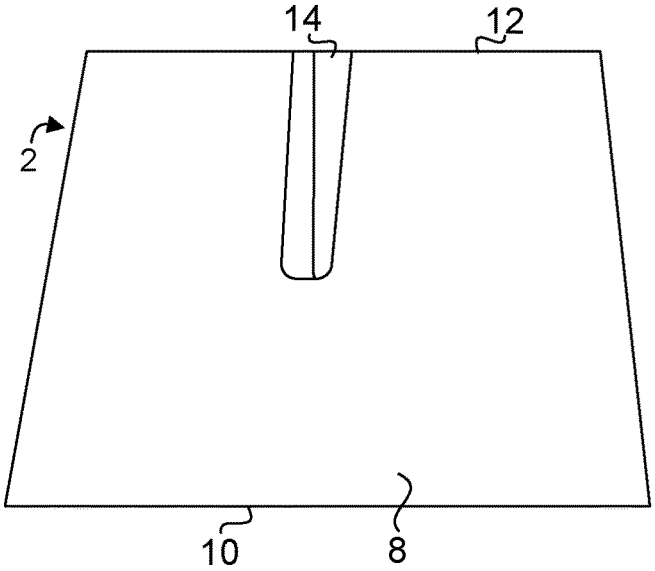
FIG. 6 is a left side view of the block thereof.
Figure 7:
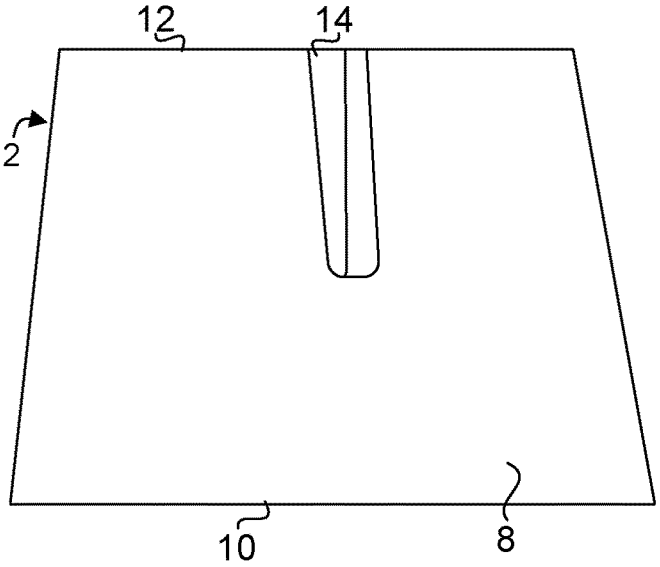
FIG. 7 is a right side view of the block thereof.
Figure 8:
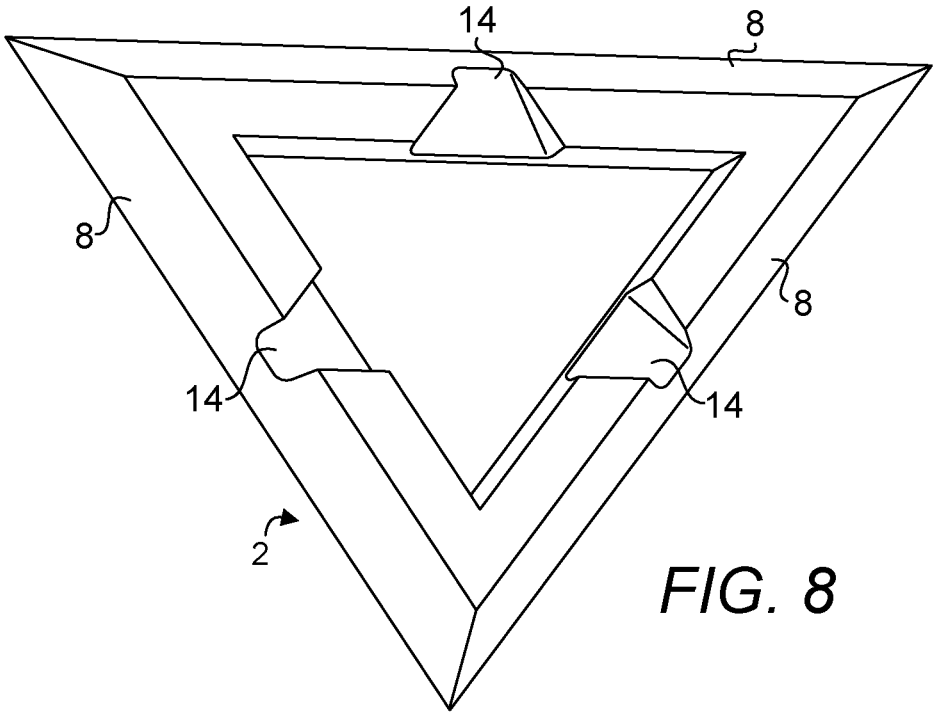
FIG. 8 is top view of the block thereof.
Figure 9:
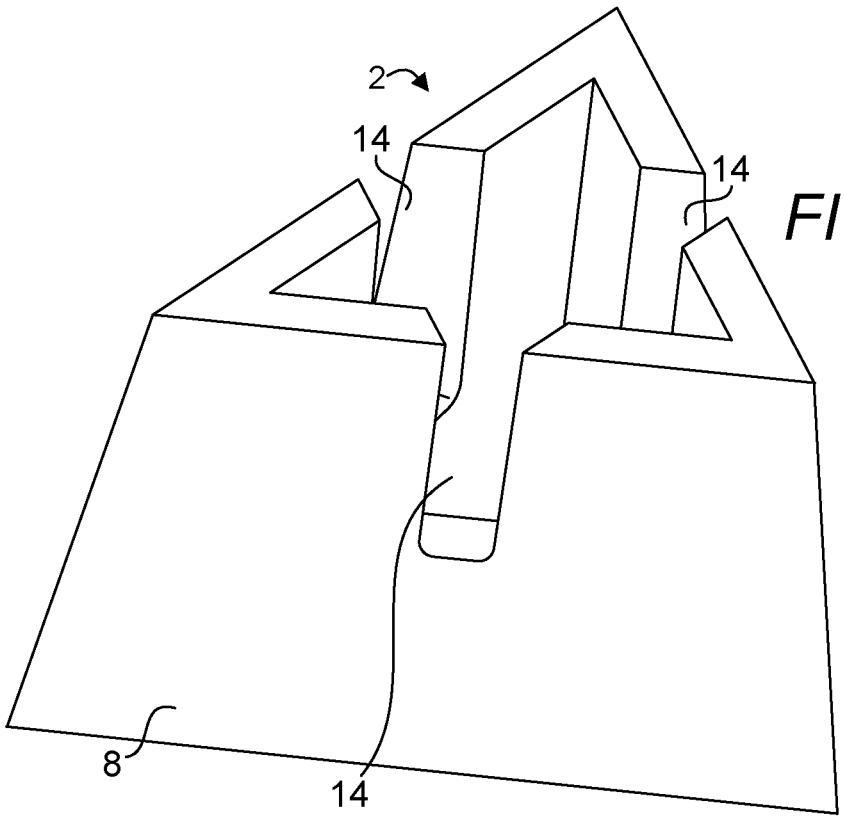
FIG. 9 is a top right side perspective of the block thereof.
Figure 10:
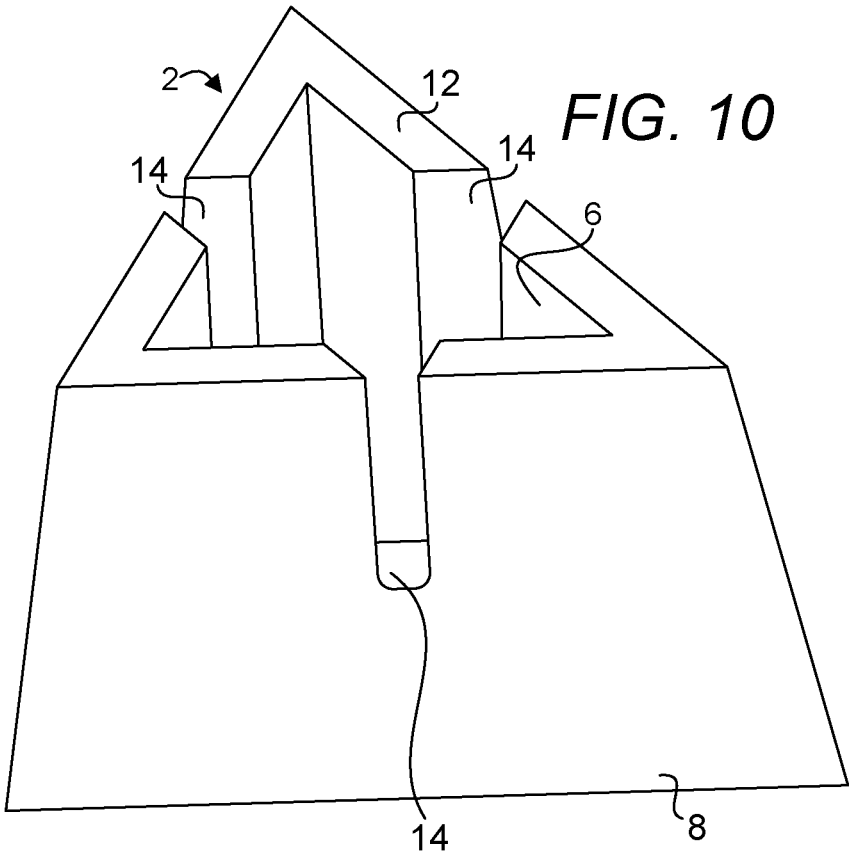
FIG. 10 is a top left side perspective view of the block thereof.
Figure 11:
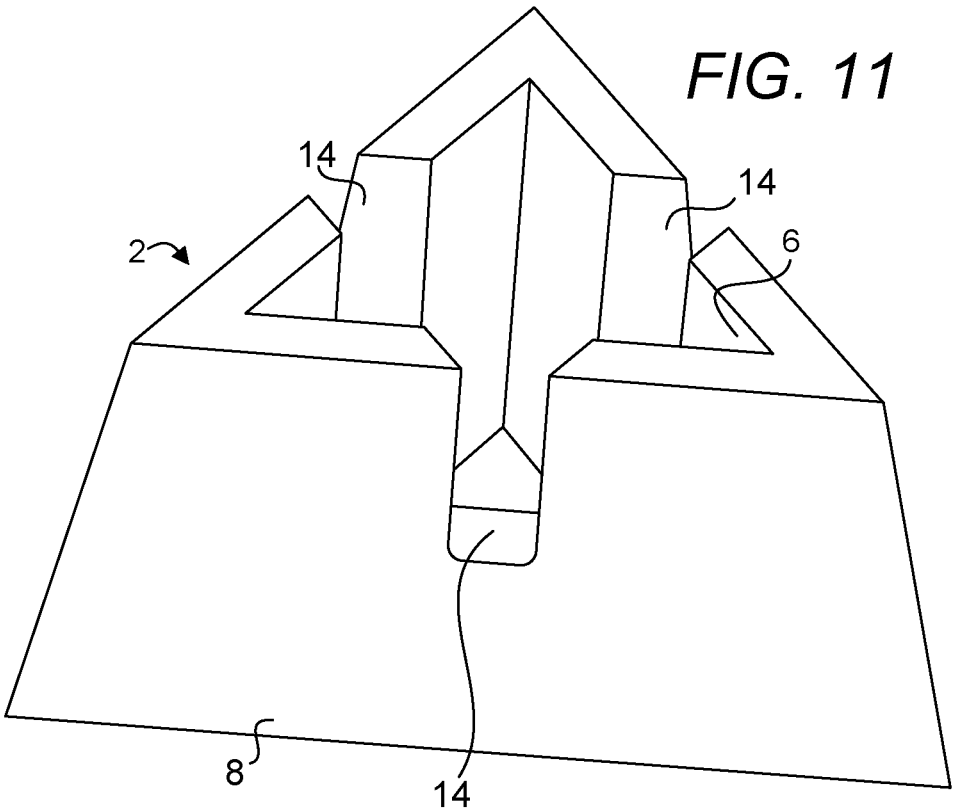
FIG. 11 is a top front perspective view of the block thereof.
Figure 14:
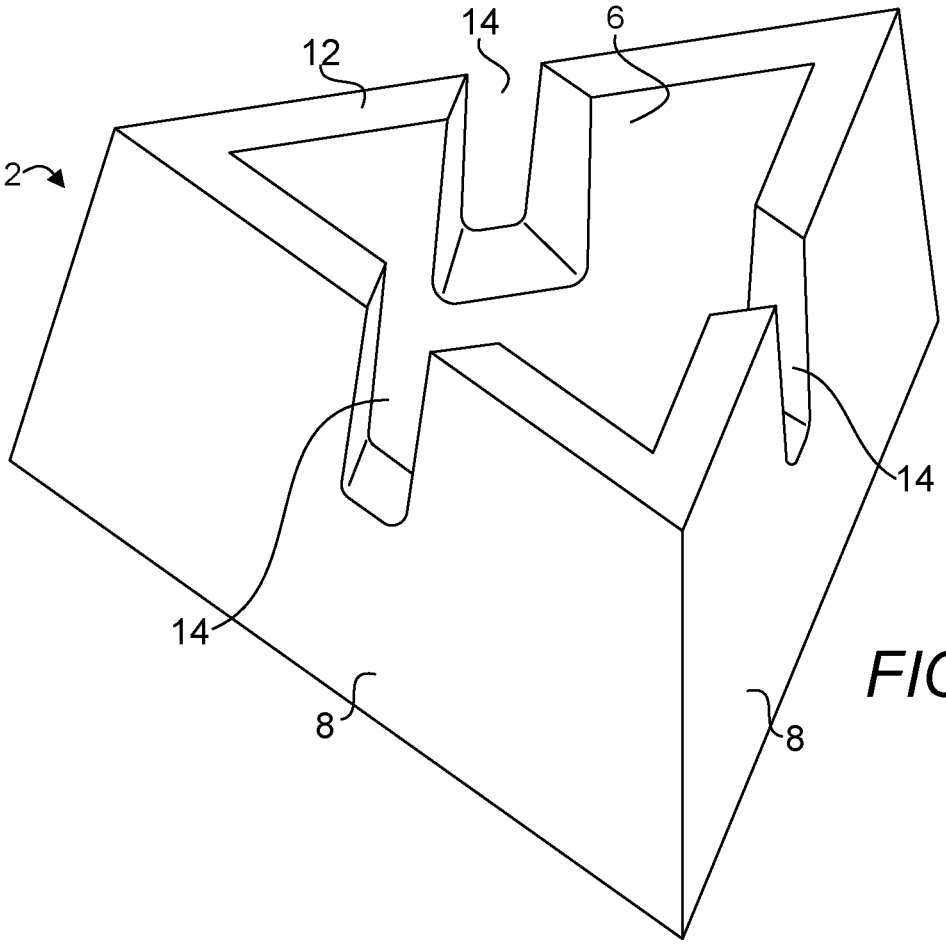
FIG. 14 is a top rear perspective view of one embodiment of a block.

Referring to FIG. 2, it shall be noted that two of the side walls have equal lengths with the length of an outside surface of an equal side wall of a pentagonal block at outer surface 12 labelled part 20 and the length of an outside surface of an equal side wall of a pentagonal block at inner surface 10 labelled part 22. The unique-length side wall has a length at the inner surface 12 labelled part 26 and a length at the outer surface 10 labelled part 24. In one embodiment, part 24 is about 16 inches and part 26 is about 12.7 inches, part 20 is about 13.8 inches and part 22 is about 10.9 inches. The width 80 of each channel 14 ranges from about 2.5 inches to about 6.0 inches on the inside surface 6 of the side wall on which the channel 14 is disposed. In one embodiment, the width 80 is preferably about 3.5 inches. In one embodiment, the channel 14 of each side wall 4 is disposed centrally along the length of its respective side wall. Referring to FIG. 4, in one embodiment, the width 82 of channel 14 ranges from about ¾ inch to about 3.0 inch on the outside surface 8 of the side wall 4, the depth 84 of channel 14 is about 4 inches and the height 28 of block 2 is about 8 inches. In one embodiment, the width 82 is preferably about 1.5 inches.

Figure 24:
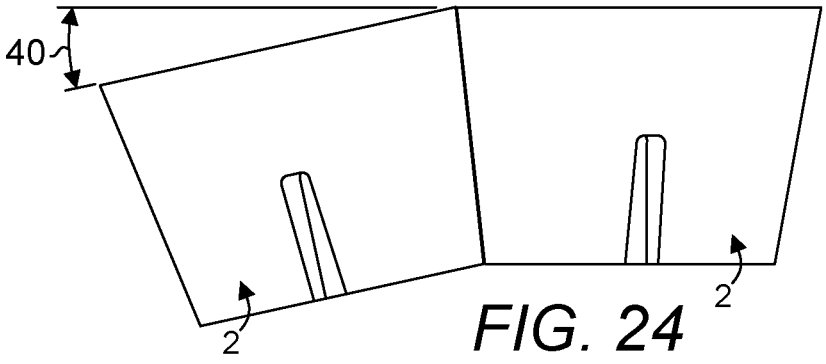
FIG. 24 depicts a combined unit of two blocks, depicting a dihedral angle that is formed as a result of combining the two blocks where no mortar has been applied.

FIG. 13 is a sectional view of a side wall of the block as taken along line A-A of FIG. 2. It shall be noted that the taper of an outside surface inwardly forms a dihedral angle 40 which is realized when two blocks are disposed adjacent one another as shown in FIG. 24. It shall also be noted that the inside surface 6 is disposed at right angle to either the inner surface 12 or the outer surface 10 while the outside surface 8 leans inwardly making the thickness 38 of the side wall diminishing from the outer surface 10 to the inner surface 12. In one embodiment, the thickness of a side wall of the present block ranges from about 1 inch to about 1.9 inches. FIG. 13A is a sectional view of a side wall of the block as taken along line B-B of FIG. 2. It shall be noted that the bottom of the channel 14 is inclined at an angle 68 or from about 3 degrees to about 12 degrees, preferably about 6 degrees, from an outside surface 8 to an inside surface 6 of a side wall 4 such that each channel conforms more readily to the curvature along the length of a rebar disposed therein.

Figure 15:
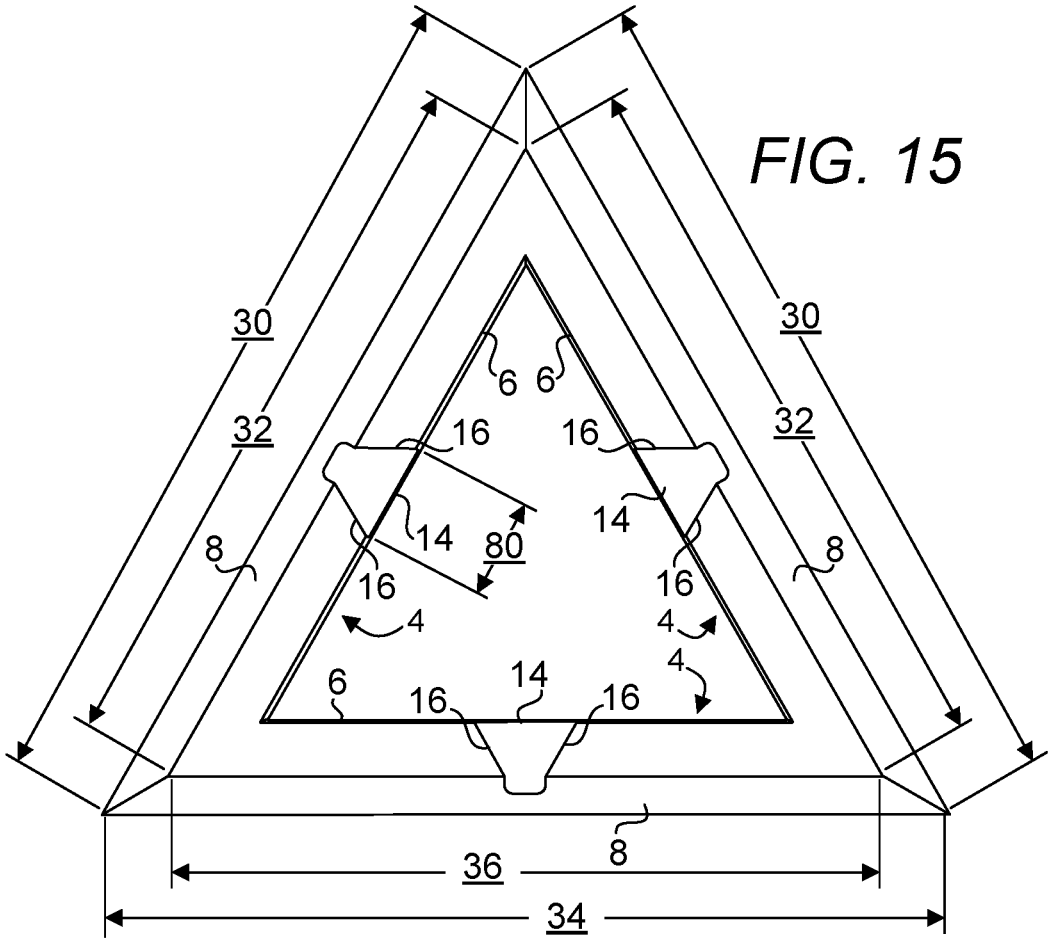
FIG. 15 is a top plan view of the block thereof.
Figure 16:
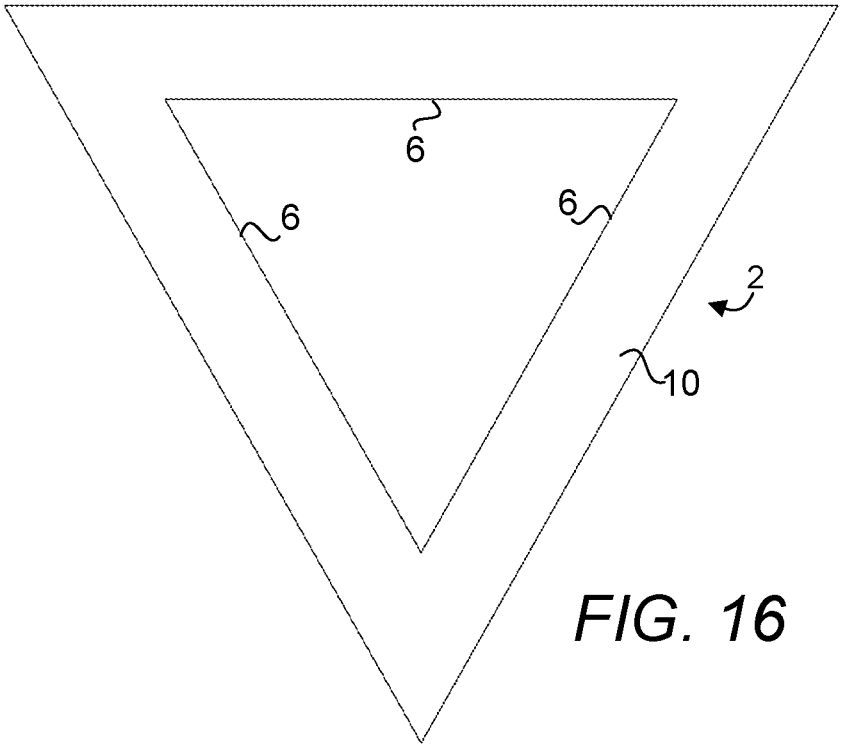
FIG. 16 is a bottom plan view of the block thereof.
Figure 17:
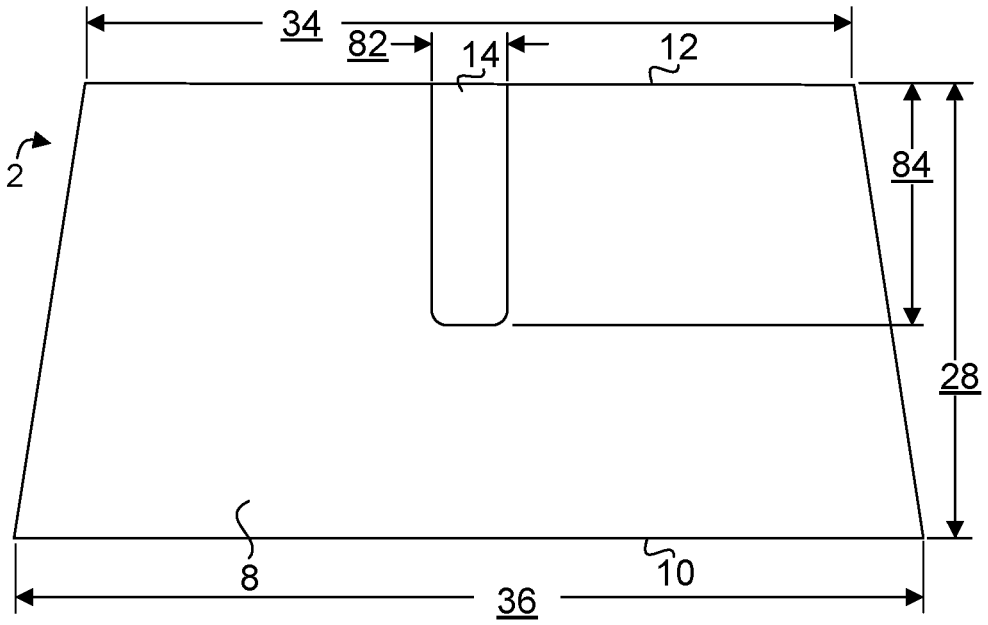
FIG. 17 is a front orthogonal view of a side wall of the block thereof.
Figure 18:
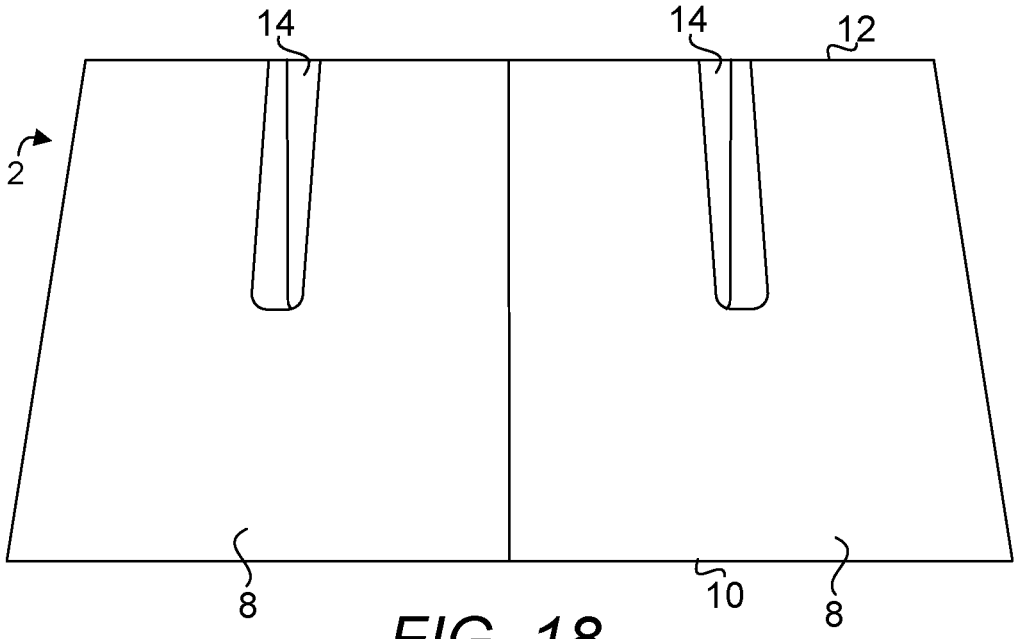
FIG. 18 is a rear view of the block thereof.
Figure 19:
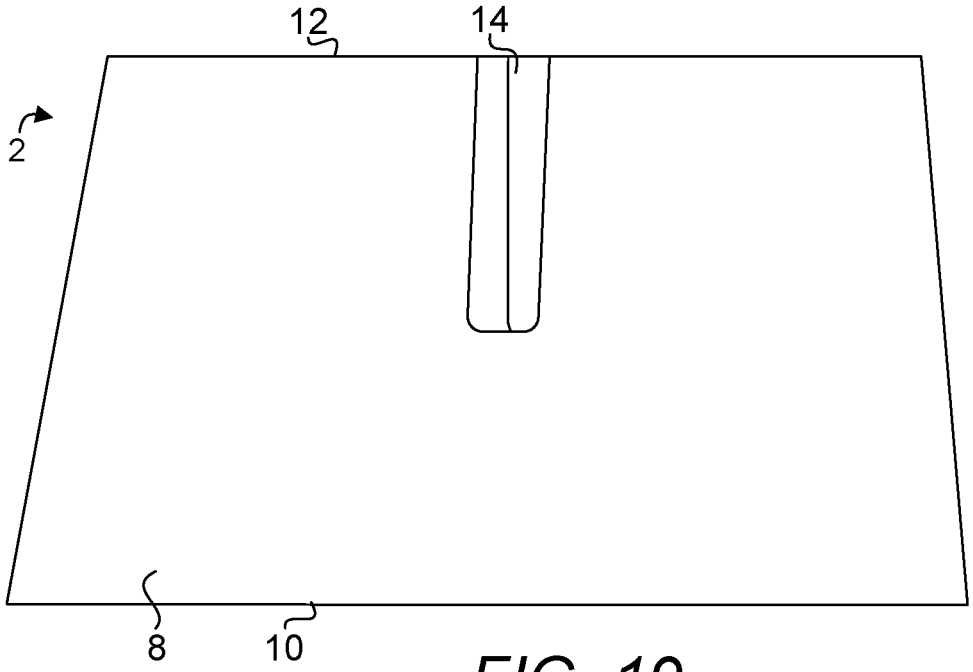
FIG. 19 is a left side view of the block thereof.
Figure 20:
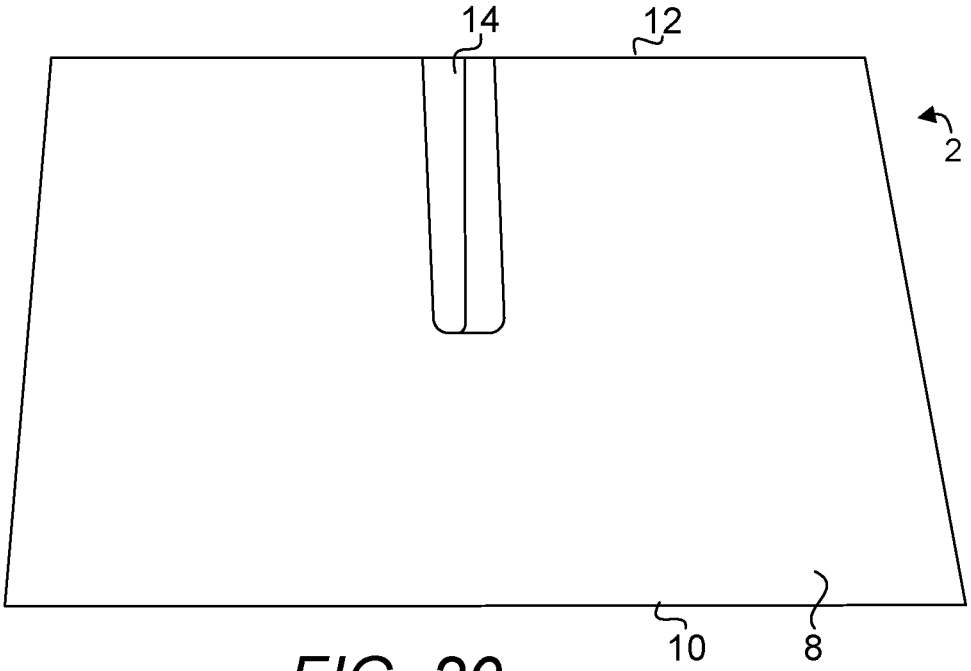
FIG. 20 is a right side view of the block thereof.
Figure 21:
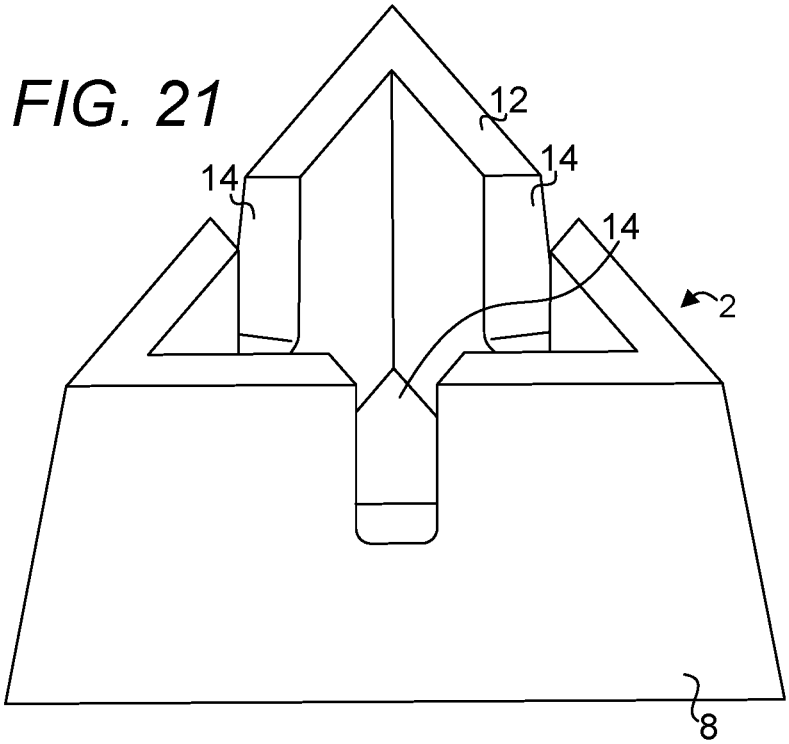
FIG. 21 is a top front perspective view of the block thereof.
Figure 22:
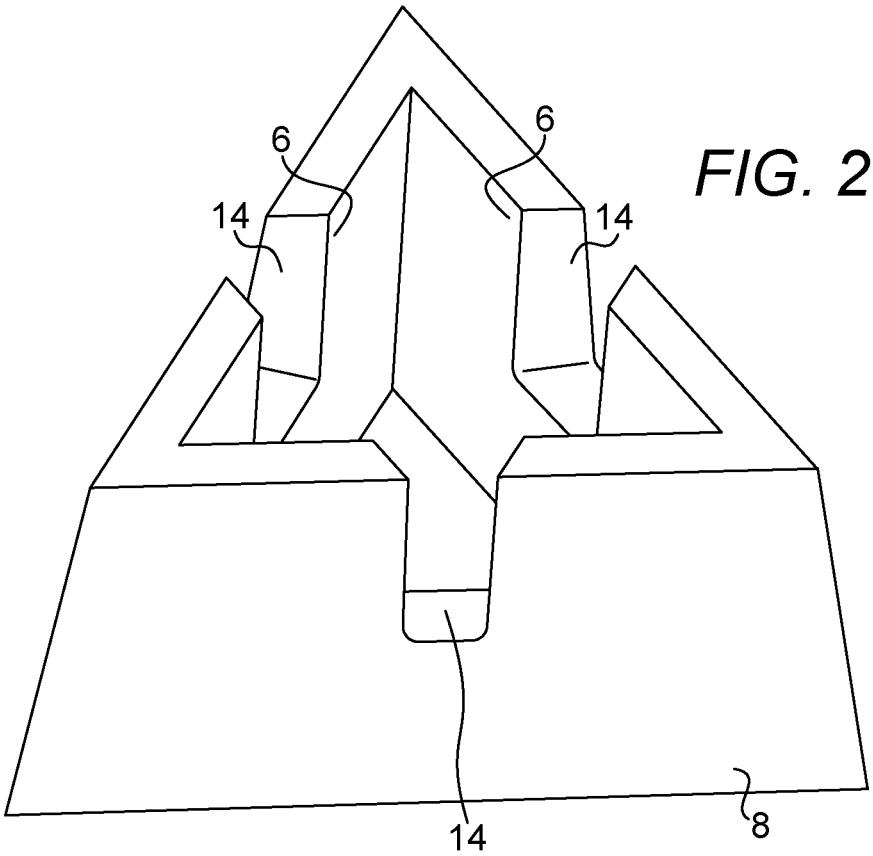
FIG. 22 is top left perspective view of the block thereof.
Figure 23:
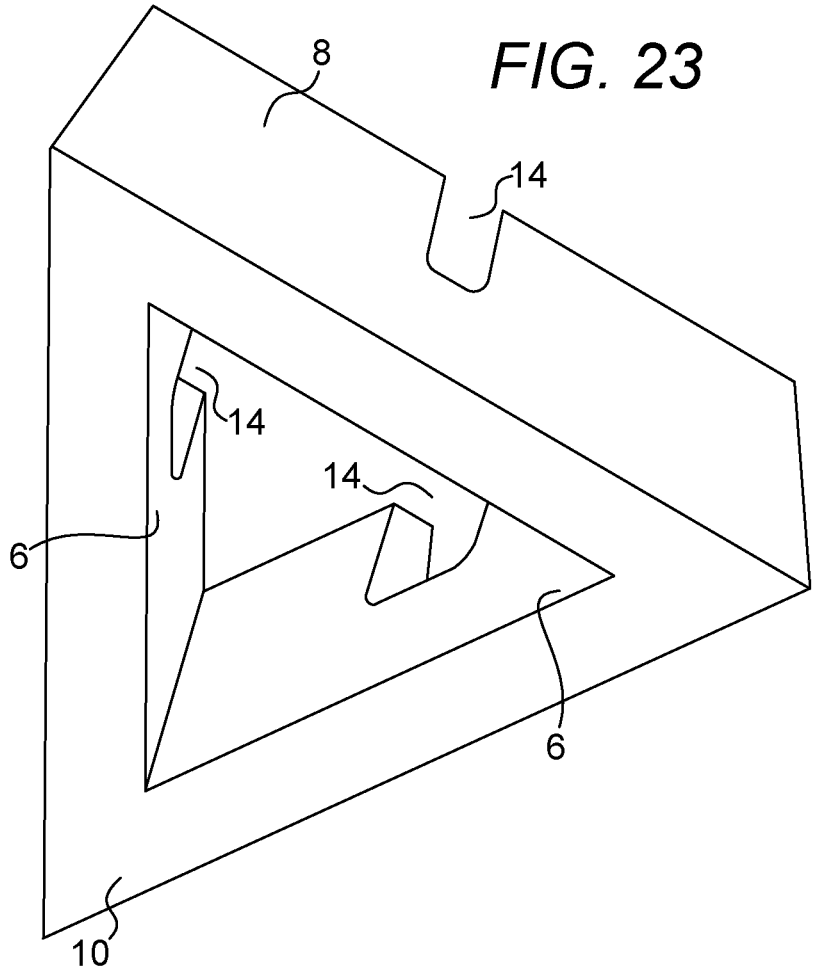
FIG. 23 is a bottom perspective view of the block thereof.

Referring to FIG. 15, it shall be noted that two of the side walls have equal lengths with the length of an outside surface of an equal side wall of a hexagonal block at outer surface 12 labelled part 30 and the length of an outside surface of an equal side wall of a hexagonal block at inner surface 10 labelled part 32. The unique-length side wall has a length at the inner surface 12 labelled part 36 and a length at the outer surface 10 labelled part 34. In one embodiment, part 34 is about 16 inches and part 36 is about 13.5 inches, part 30 is about 16.2 inches, part 32 is about 13.7 inches. Again, each channel 14 of a side wall 4 is centrally disposed on a side wall 4 of the block 2. The width 80 of each channel 14 ranges from about 2.5 inches to about 6.0 inches on the inside surface of the side wall on which the channel 14 is disposed. In one embodiment, the width 80 is preferably about 3.5 inches. Each side wall 16 of a channel 14 is essentially parallel to the top or bottom edge of an inside surface of a side wall 6. In one embodiment, a wall 16 surface of a channel 14 is disposed in a parallel manner with an inside surface of the side wall 6 wall 16 faces. Referring to FIG. 17, in one embodiment, the width 82 of channel 14 ranges from about ¾ inch to about 3.0 inches on the outside surface 8 of the side wall 4, the depth 84 of channel 14 is about 4 inches and the height 28 of block 2 is about 8 inches. In one embodiment, the width 82 is preferably about 1.5 inches.

In this embodiment, a spherical dome constructed from blocks having such dimensions may span about 8 ft. in diameter for a first frequency structure, 16 ft. in diameter for a second frequency structure and 24 ft. in diameter for a third frequency structure. The area of the outer surface 10 is configured to be greater than the area of the inner surface 12 such that a structure constructed from a plurality of such blocks can result in a convex outer surface and the blocks can be interlocked under their own weight. Therefore, in general, each side wall of a present block is disposed at an angle that is not right angle to either the outer surface or inner surface and each side wall leans inwardly towards the center of the inner surface.

Suitable materials for constructing a present block include, but not limited to, concrete, cinders, vitrified ceramic, glass, plastic, wood pulp, cardboard, fiberglass, epoxy composite, metal, construction foam, tamped earth, boron, borides, and any combinations thereof. The decision to select a material lies in such factors as the manufacturing costs, material costs, ease of construction, availability of materials, ease of use of the resultant blocks, required strength of the resultant blocks, maintenance requirement of the resultant blocks, etc. Care shall also be taken to create blocks with rounded edges or corners as they are often stress concentrators that can inadvertently come in contact with and bear point loads that can eventually lead to pre-mature failures. Although the present blocks may be depicted with edges that appear to be sharp edges, it shall be understood that standard block forming practices can be readily applied to remove stress concentrations that may arise due to these sharp edges.

Figure 25:
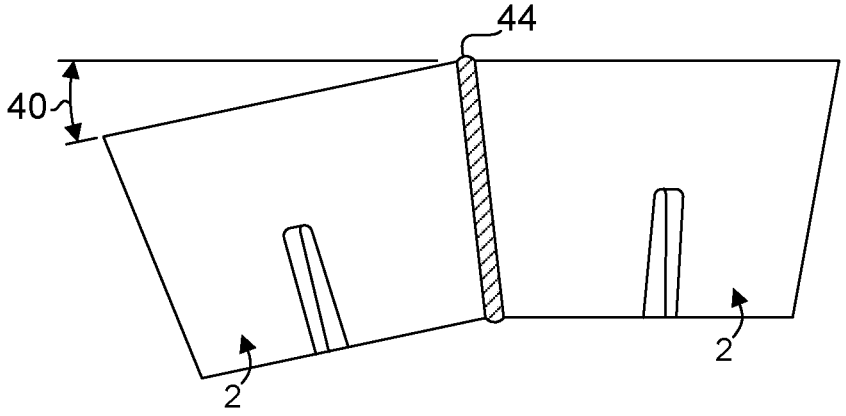
FIG. 25 depicts a combined unit of two blocks, depicting a dihedral angle that is formed as a result of combining the two blocks where mortar has been applied and an angle between blocks has been maintained.
Figure 26:
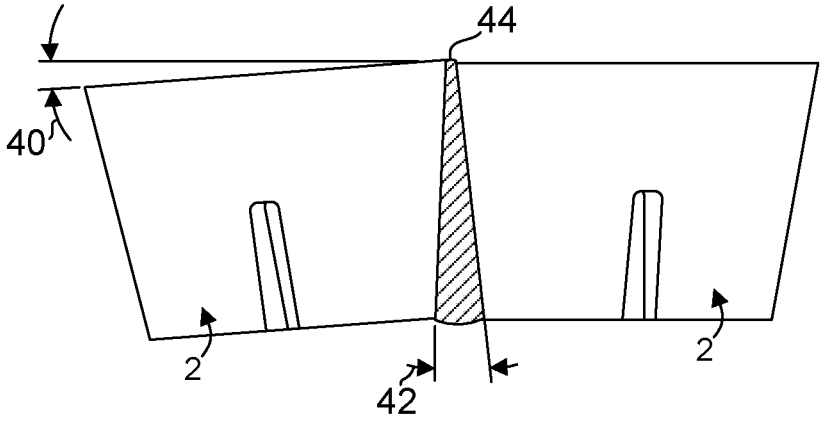
FIG. 26 depicts a combined unit of two blocks, depicting an angle between blocks that is formed as a result of combining the two blocks where mortar has been applied and the angle between blocks has been altered from that shown in FIG. 25.
Figure 27:
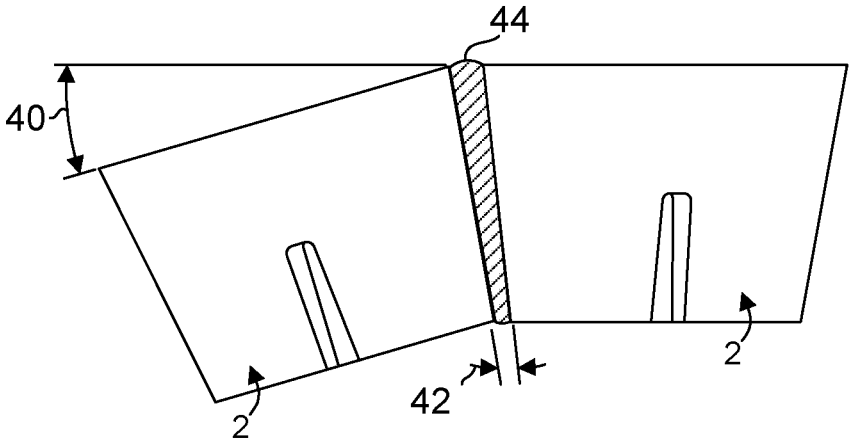
FIG. 27 depicts a combined unit of two blocks, depicting an angle between blocks that is formed as a result of combining the two blocks where mortar has been applied and the angle between blocks has been altered from those shown in FIGS. 25 and 26.

FIGS. 24-27 depict a manner in which each pair of blocks are coupled which forms the foundation of the curve that results from combining a plurality of such blocks to form a curvilinear structure, e.g., a sphere or a spherical dome. Notice that, in this example, the blocks are disposed such that their walls face the reader and the blocks are arranged such that the left wall of the right block is aligned with the right wall of the left block. FIG. 24 depicts a combined unit of two blocks, depicting a dihedral angle 40 that is formed as a result of combining the two blocks. The left wall of the right block is mated with the right wall of the left block. No mortar or gasket is shown used to fill the gap between the two blocks in FIG. 24. Suitable dihedral angles range from about 0.5 degree to about 12 degrees. A higher order of frequency structure generally requires blocks that will result in lower dihedral angles between blocks while a low order of frequency structure generally requires blocks that will result in larger dihedral angles between blocks. The surface curvature per unit area of a structure having a higher order of frequency is therefore generally more severe than the surface curvature per unit area of a structure having a lower order of frequency. In practice and during installation, the angle 42 made between two blocks can also be altered via the application of mortar or gasket. FIG. 25 depicts a combined unit of two blocks, depicting a dihedral angle that is formed as a result of combining the two blocks. In this example, mortar or a gasket 44 is applied to the gap between the two blocks while the dihedral angle 40 formed of the two blocks is maintained. It shall be noted that the gap between the two blocks are maintained throughout the height of the blocks. Therefore, the angle made between the two blocks is the same as the dihedral angle 40. FIG. 26 depicts a combined unit of two blocks, depicting an angle between blocks that is formed as a result of combining the two blocks where mortar or a gasket 44 has been applied and the angle between blocks has been altered by rotating the left block clockwise and therefore widening the gap between the two blocks with respect to their inner walls and filling the gap with mortar or a gasket forming an angle 40 between the two blocks. FIG. 27 depicts a combined unit of two blocks, depicting an angle between blocks that is formed as a result of combining the two blocks where mortar or a gasket has been applied and the angle between blocks has also been altered. Compared to FIG. 26, angle 40 has been reduced by rotating the left block counterclockwise. It can therefore be seen that the radius of a sphere or spherical dome can be adjusted by adjusting the dihedral angle between each pair of abuttingly placed blocks and/or by adjusting the angle formed between the pair.

Figure 28:
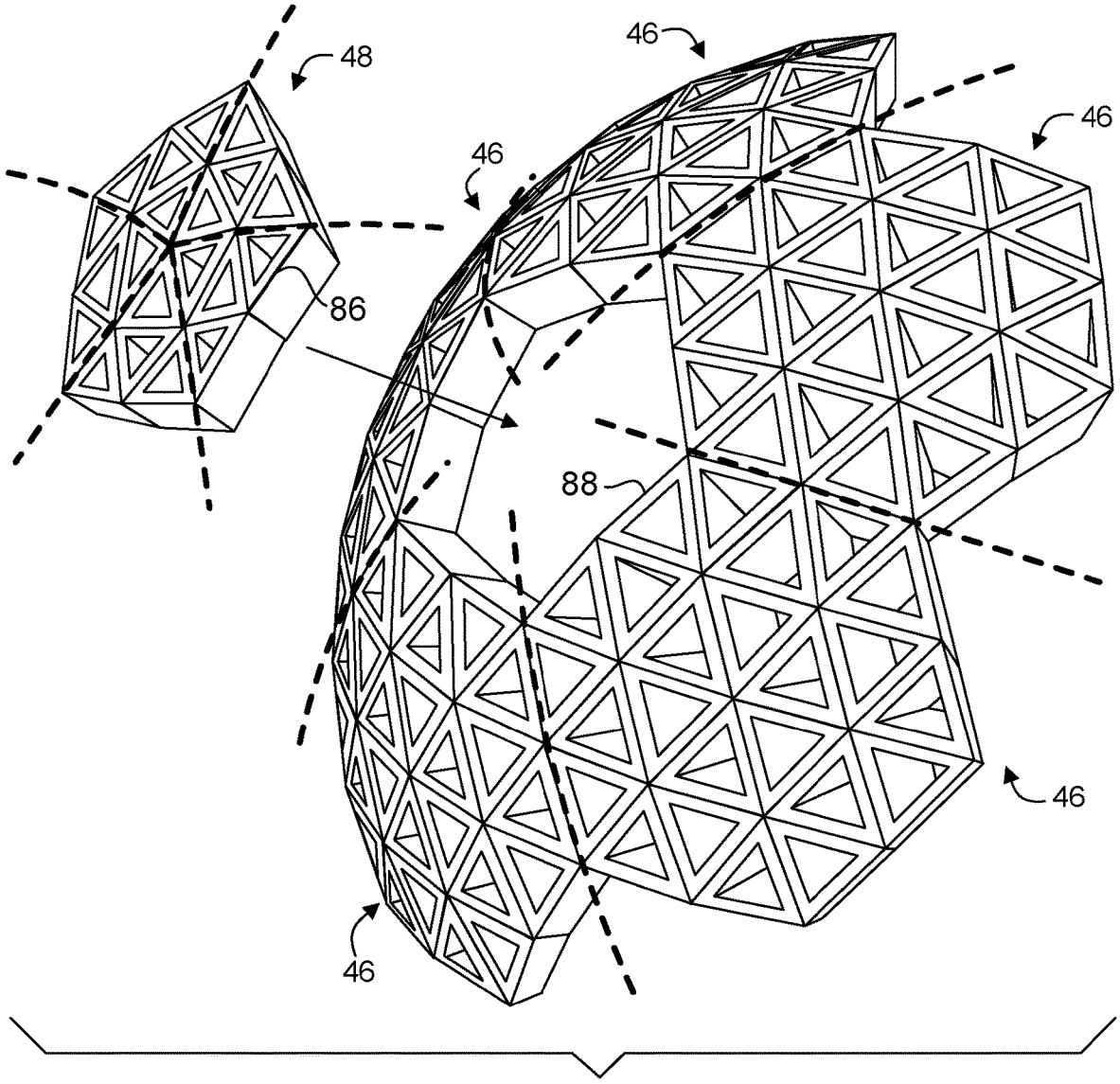
FIG. 28 is a top perspective view of a partial single-wythed spherical dome built with a plurality of present blocks.
Figure 29:
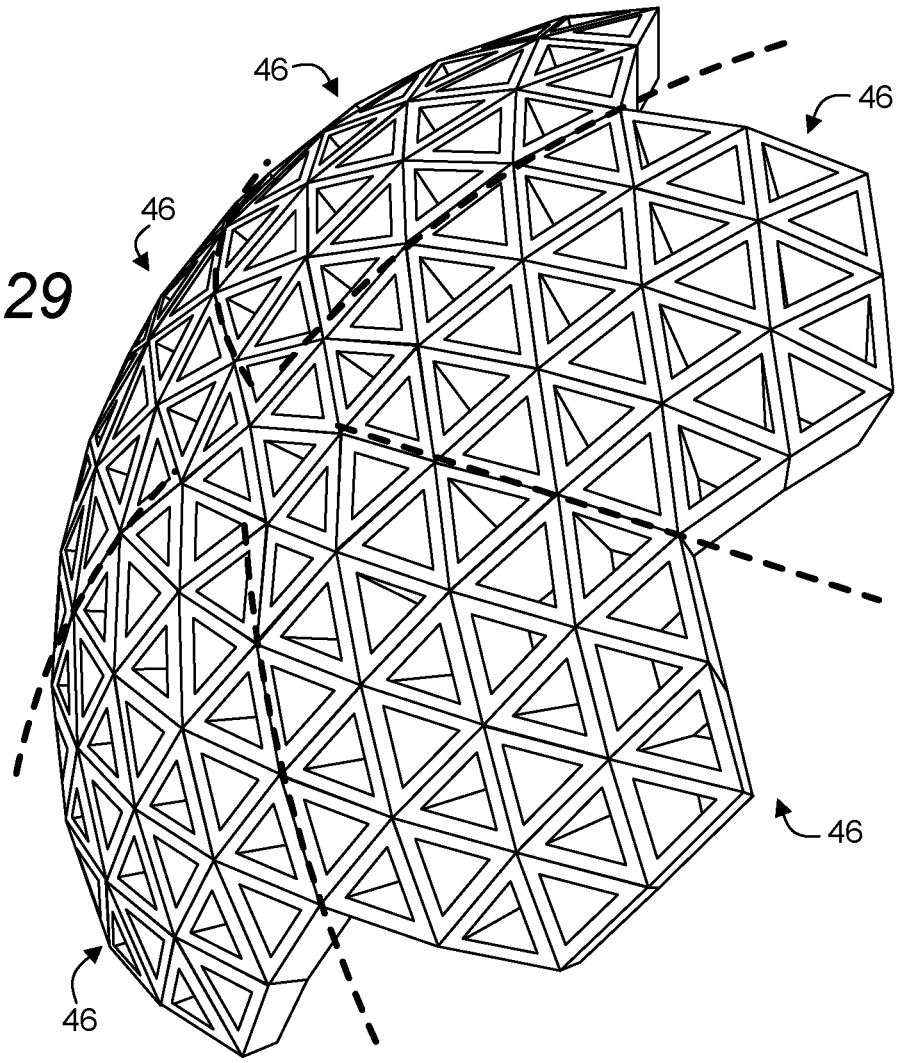
FIG. 29 is a top perspective view of a partial single-wythed spherical dome built with a plurality of present blocks, depicting a pentagonal group of blocks having been installed in the gap shown in FIG. 28.

Having described the manner in which a curvature can be formed from a pair of blocks, it is now clear that a plurality of the present blocks may then be used to build a sphere or spherical dome. In the ensuing example, a plurality of present blocks are shown to be assembled in a manner to form a Goldberg polyhedron. A Goldberg polyhedron is a convex polyhedron made from hexagons and pentagons. FIG. 28 depicts partial structures constructed using a plurality of present blocks arranged in a second frequency structure. Dotted lines shown in FIG. 28 are used to delineate the boundaries of hexagonal groups of blocks 46. FIG. 28 is a top perspective view of a partial single-wythed spherical dome built with a plurality of present blocks. FIG. 29 is a top perspective view of a partial single-wythed spherical dome built with a plurality of present blocks arranged in a second frequency structure, depicting a pentagonal group 48 of blocks having been installed in a gap shown in FIG. 28. Such a pattern of engagement of the blocks can be replicated to form an assembled or installed blocks 46 in the shape of a hexagon as shown in FIG. 28. It shall be noted that, with the order of frequency of the hexagonal groups 46 shown in FIG. 28, there is a total of twenty four blocks used for forming each hexagonal group. There is a total of five hexagonal groups of blocks 46, each connected to two other hexagonal groups of blocks 46 to form an opening in the shape of a pentagon. The gap or space can then be sealed with a pentagonal group of blocks 48 built from a total of twenty blocks 2 to result in a configuration shown in FIG. 29. It shall be noted that the configuration shown in FIGS. 28-29 is a single-wythed configuration. No channels are shown in FIGS. 28-29. A structure constructed from the present blocks 2 need not be single-wythed as there are constructions where multi-wythed structures are required, e.g., in applications where external loading to the structures is significant, e.g., environmental impacts and stresses encountered in tornadoes, hurricanes, tsunamis, earthquakes and other extreme loading scenarios. An additional wythe may be added either over the outer wythe or under the inner wythe. Spheres or spherical domes of any size can be built with these blocks as construction using blocks is scalable. A spherical dome twice as large as a structure constructed with a single wythe requires walls twice as thick, i.e., another wythe is required to create a wall twice as thick. If an additional wythe is used, a wall three times as thick or a sphere section that is three times larger than the single wythe sphere section can be created.

This feature adds to the design flexibility of the present block by allowing structures to any sizes to be built. Note in FIG. 28 that edge 86 of a pentagonal block of a pentagonal group of blocks must match edge 88 of a hexagonal block of a hexagonal group of blocks in order for the pentagonal group of blocks to be installed within the gap surrounded by the hexagonal groups of blocks.

Figure 30:
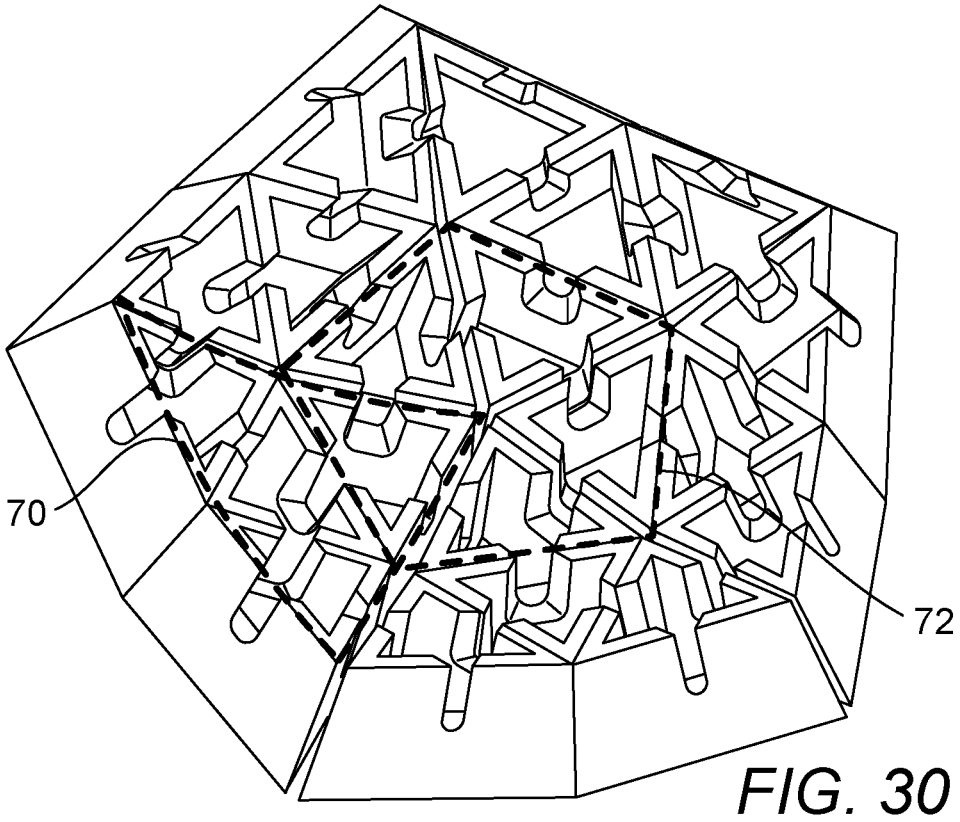
FIG. 30 is a bottom perspective view of a partial single-wythed spherical dome built with a plurality of present pentagonal blocks arranged in a second frequency structure.
Figure 31:
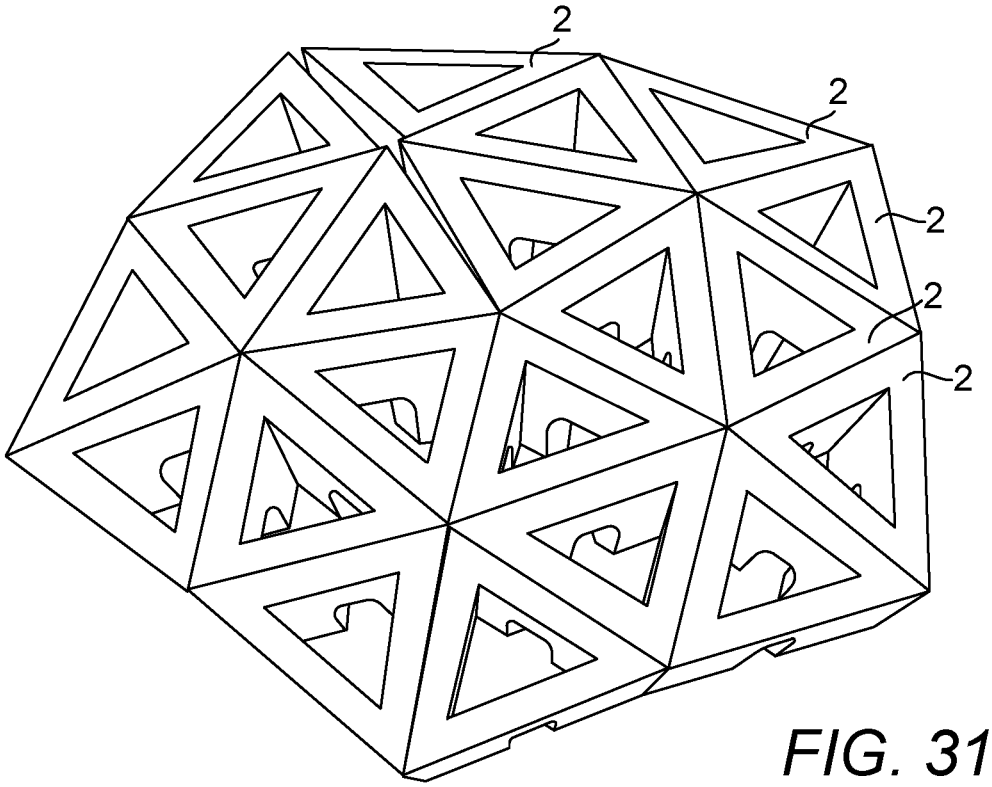
FIG. 31 is a top perspective view of a partial single-wythed spherical dome built with a plurality of present pentagonal blocks arranged in a second frequency structure.
Figure 32:
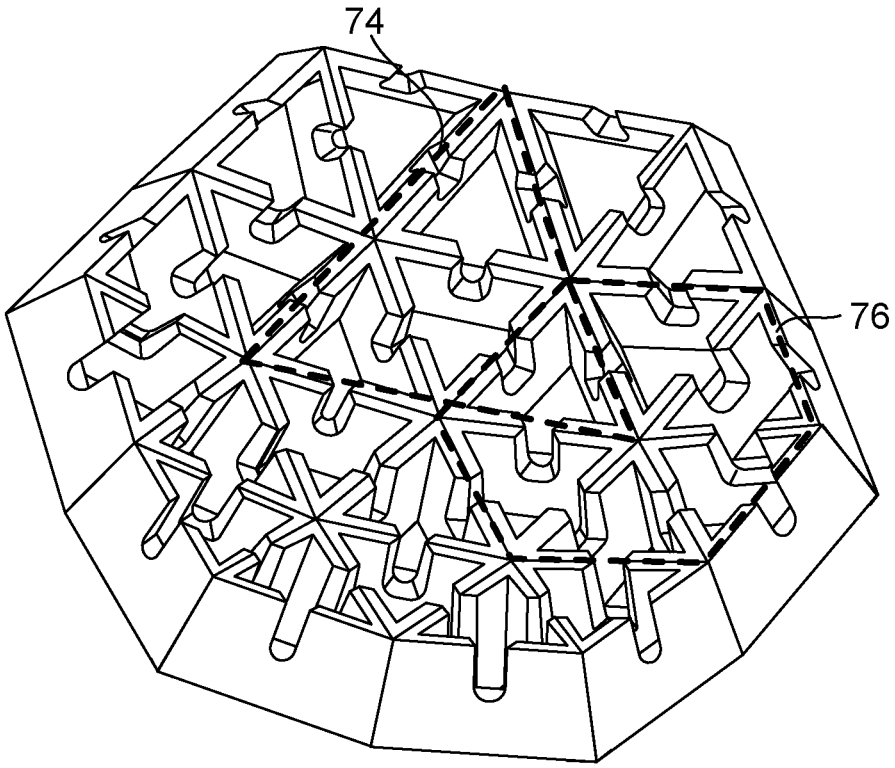
FIG. 32 is a bottom perspective view of a partial single-wythed spherical dome built with a plurality of present hexagonal blocks arranged in a second frequency structure.
Figure 33:
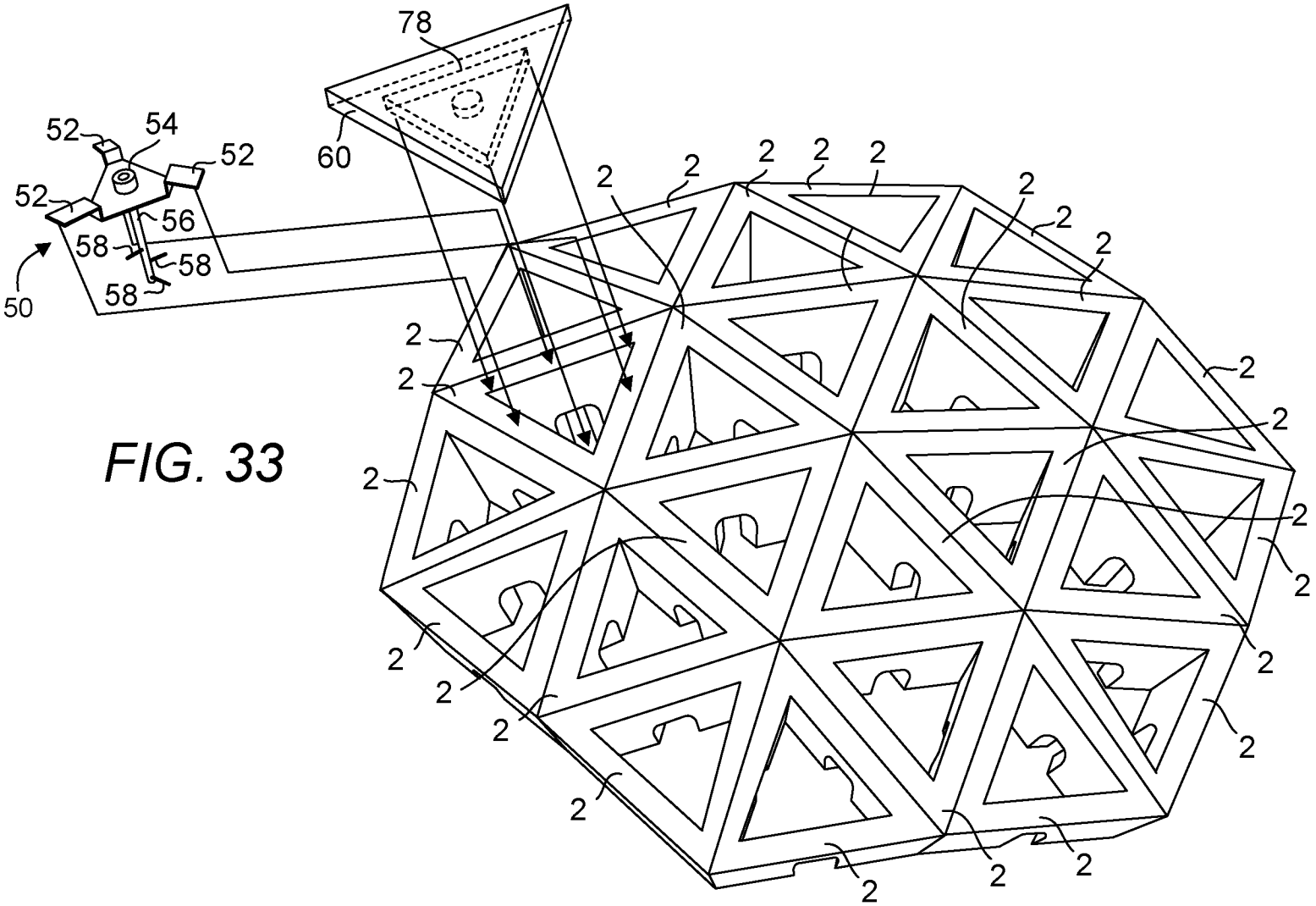
FIG. 33 is a top perspective view of a partial single-wythed spherical dome built with a plurality of present hexagonal blocks arranged in a second frequency structure.

FIG. 30 is a bottom perspective view of a partial single-wythed spherical dome built with a plurality of present pentagonal blocks arranged in a second frequency structure. FIG. 31 is a top perspective view of a partial single-wythed spherical dome built with a plurality of present pentagonal blocks arranged in a second frequency structure. FIG. 32 is a bottom perspective view of a partial single-wythed spherical dome built with a plurality of present hexagonal blocks arranged in a second frequency structure. FIG. 33 is a top perspective view of a partial single-wythed spherical dome built with a plurality of present hexagonal blocks arranged in a second frequency structure. FIG. 33 depicts an example the structure formed of a plurality of the present blocks 2 can be covered. In one embodiment, there is provided a cladding 60 shaped according to the outer surface of a block to cover each block which includes a protrusion 78 at its bottom configured to plug the opening of the tube formed of three side walls of a block 2. Only one cladding 60 is shown. In one embodiment, the cladding is constructed from a material similar to one used for the block itself. In one embodiment, the cladding is installed flush with the outer surface of its corresponding block, i.e., without protrusion 78. Further, in one embodiment, an anchor 50 is provided for each block where the anchor 50 is configured to positively secure a rebar. Only one anchor is shown. The reader shall refer to FIGS. 38-40 for further clarification on the manner in which a rebar is secured with the aid of an anchor 50. In one embodiment, the anchor includes a bolt 56 having a threaded first end such that it can be received at a nut 54 supported on a plate having protrusions 52 that can be used to secure an installed rebar against the outer surface 10 and a plurality of protrusions 58 disposed on a second end. The protrusions 58 are preferably disposed such that they extend at right angle from the bolt 56 and disposed in a helical fashion along the length of the bolt 56 such that the bolt 56 can be secured at the nut 54 by a turning action until a rebar 18 is disposed between two successive protrusions 58.

Figure 34:
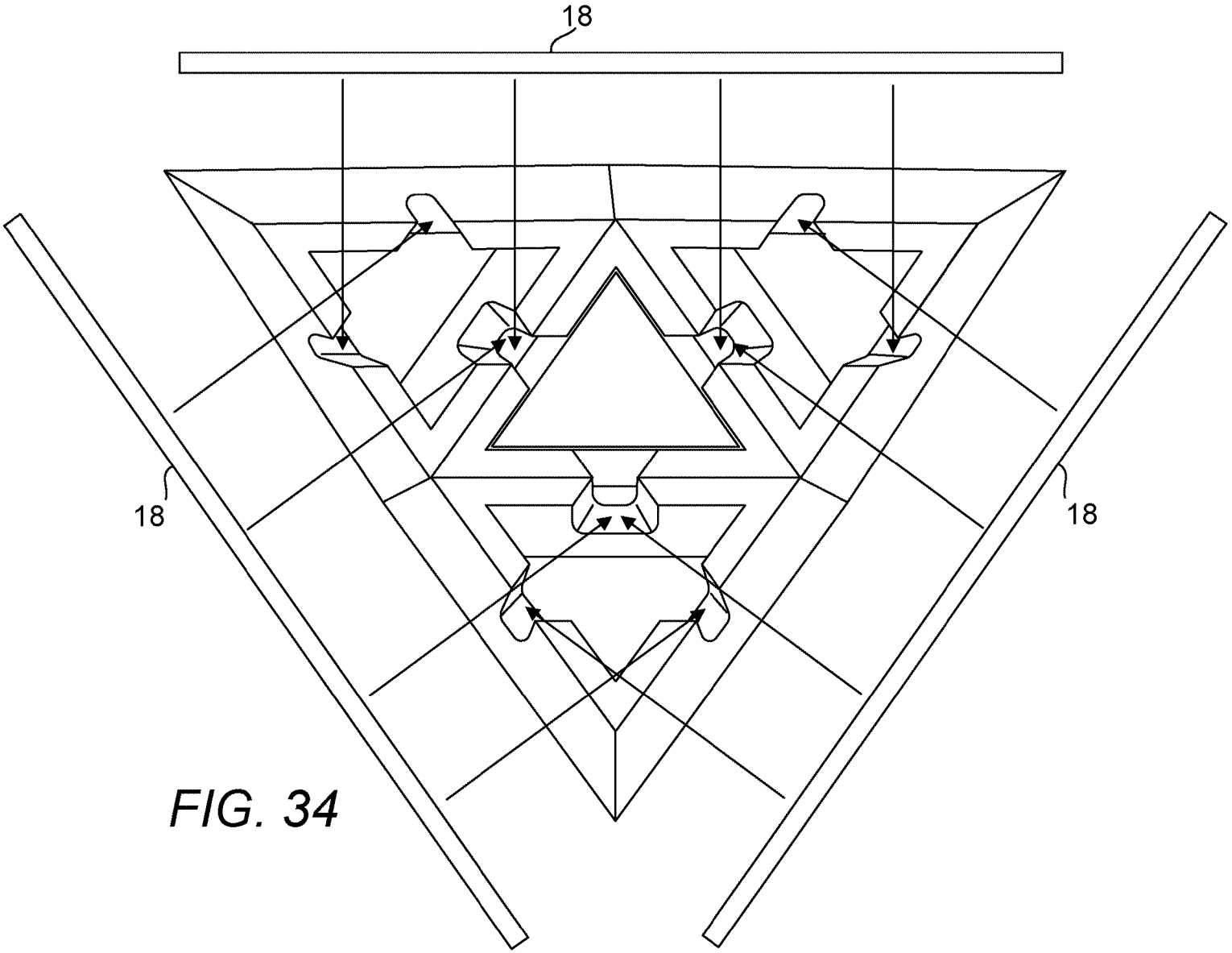
FIG. 34 is a bottom perspective view of an arrangement of a subset of blocks shown in the structure of FIG. 30.
Figure 35:
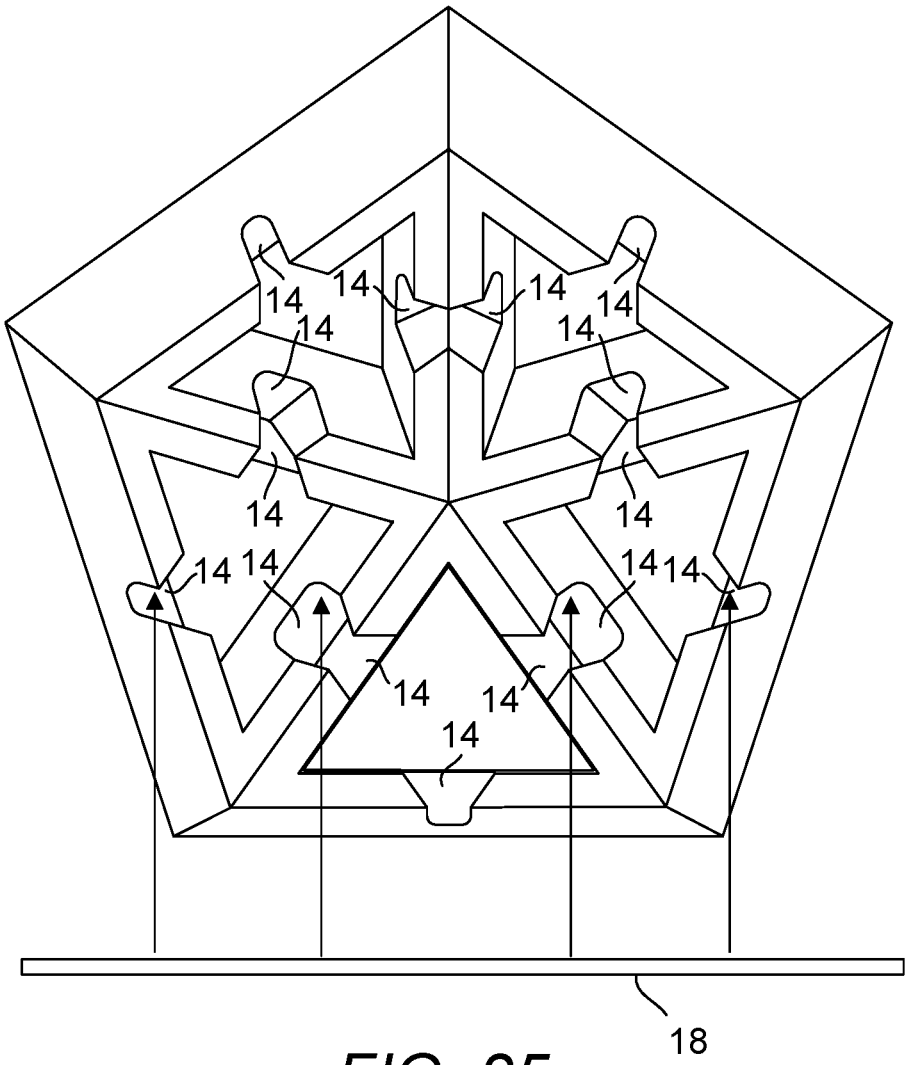
FIG. 35 is a bottom perspective view of an arrangement of a subset of blocks shown in the structure of FIG. 30 or a first frequency structure of the pentagonal blocks.
Figure 36:
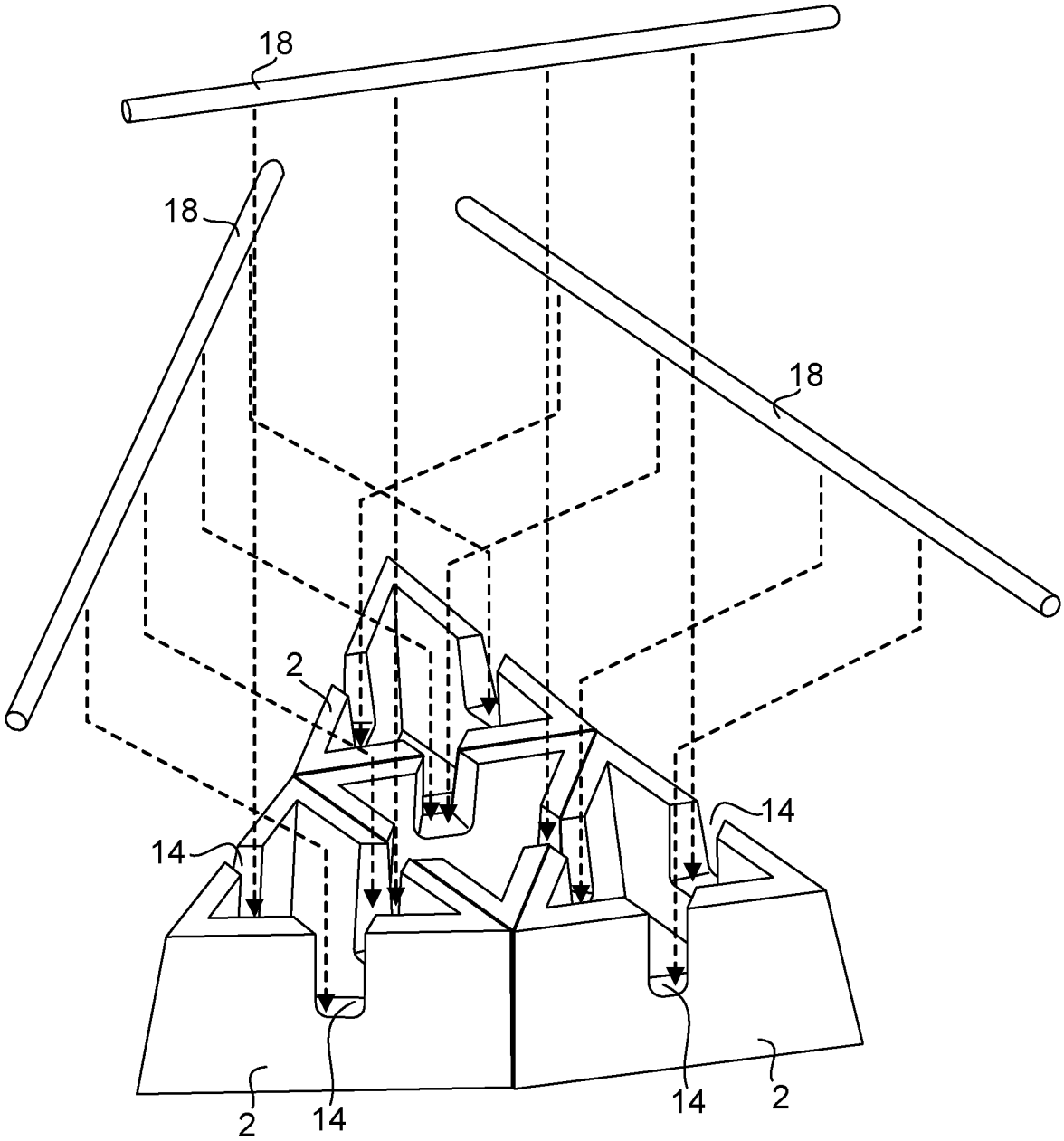
FIG. 36 is a bottom perspective view of an arrangement of a subset of blocks shown in the structure of FIG. 32.
Figure 37:
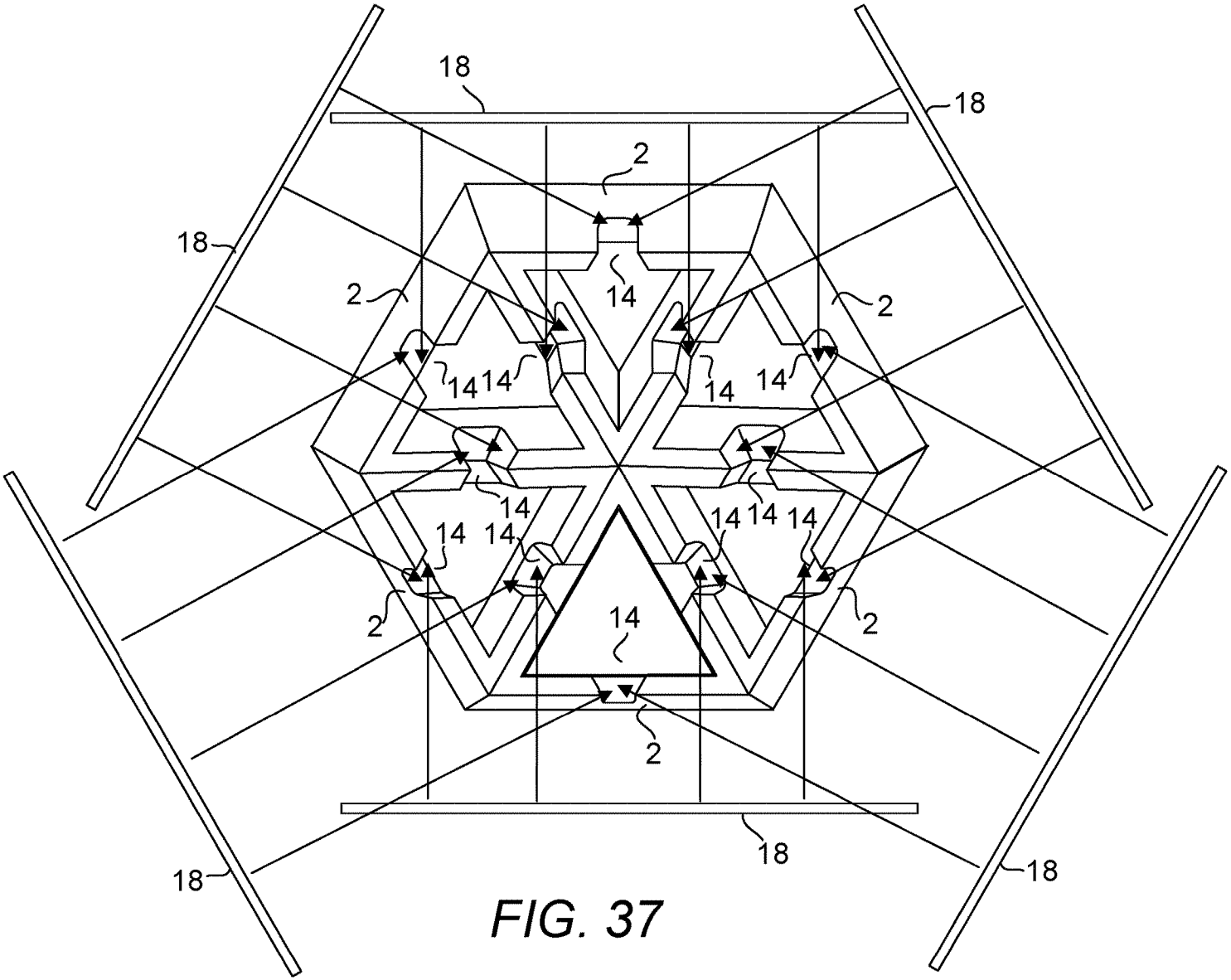
FIG. 37 is a bottom perspective view of an arrangement of a subset of blocks shown in the structure of FIG. 32 or a first frequency structure of the hexagonal blocks.

FIG. 34 is a bottom perspective view of an arrangement of a subset of blocks shown in the structure of FIG. 30, e.g., arrangement 70. FIG. 35 is a bottom perspective view of an arrangement of a subset of blocks shown in the structure of FIG. 30, e.g., arrangement 72, or a first frequency structure of the pentagonal blocks. FIG. 36 is a bottom perspective view of an arrangement of a subset of blocks shown in the structure of FIG. 32, e.g., arrangement 74. FIG. 37 is a bottom perspective view of an arrangement of a subset of blocks shown in the structure of FIG. 32, e.g., arrangement 76, or a first frequency structure of the hexagonal blocks. It shall be noted that each of the blocks 2 in these arrangements is connected to at least one other block adjacent it via a rebar 18. Each of those blocks bounding each arrangement includes a side wall having one or two channels ready to receive a rebar that can be shared with additional blocks not shown.

Figure 38:
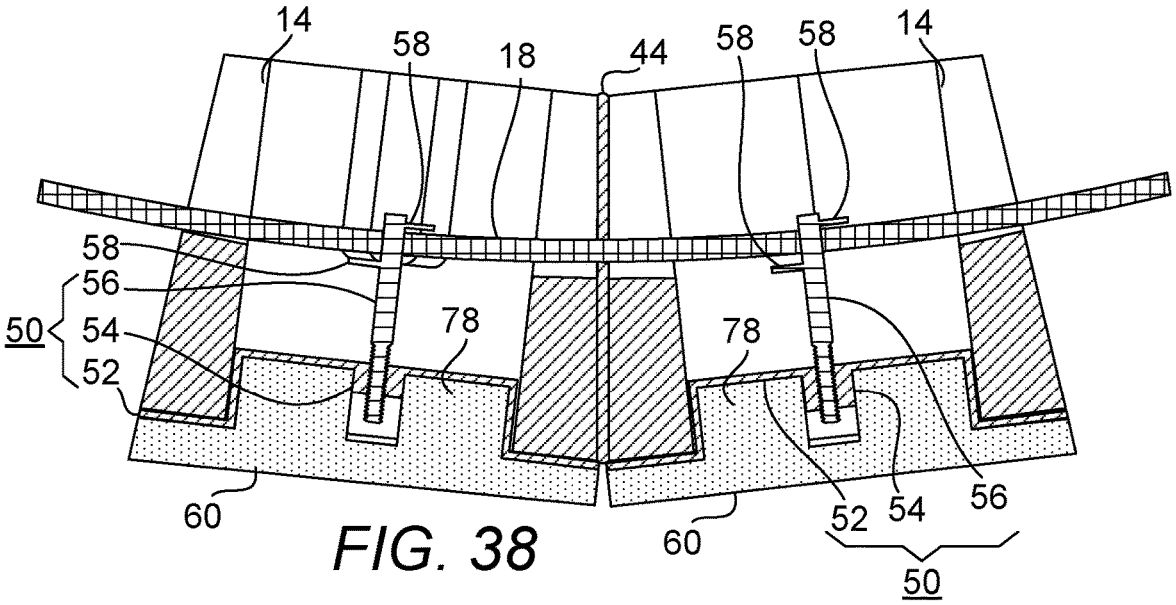
FIG. 38 is a side cross-sectional view of two adjacently disposed blocks.
Figure 39:
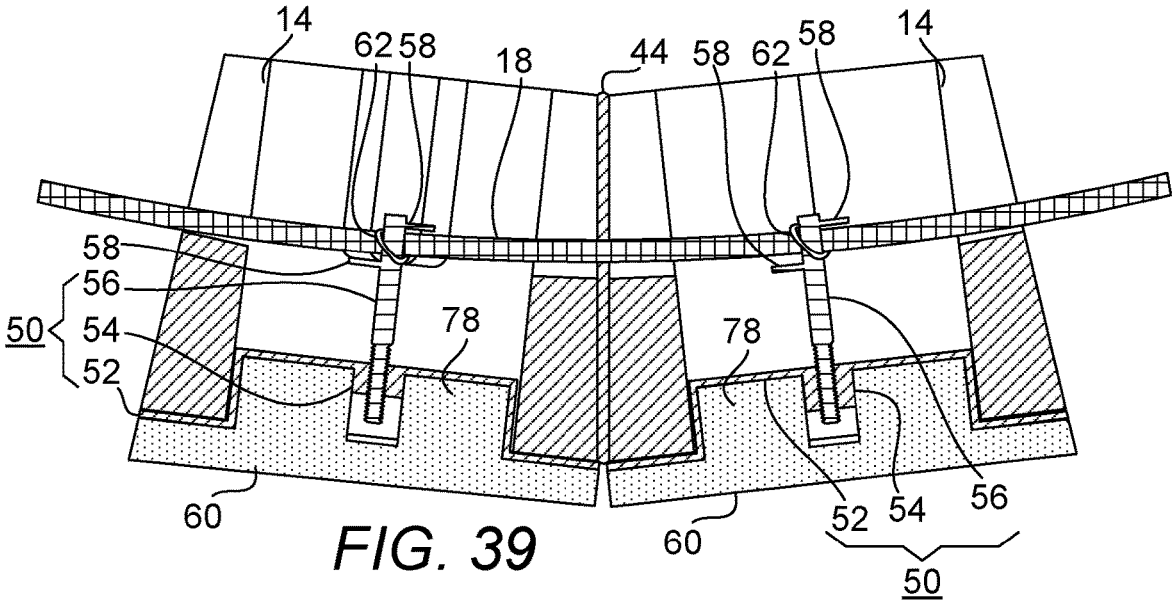
FIG. 39 is a side cross-sectional view of two adjacently disposed blocks.
Figure 40:
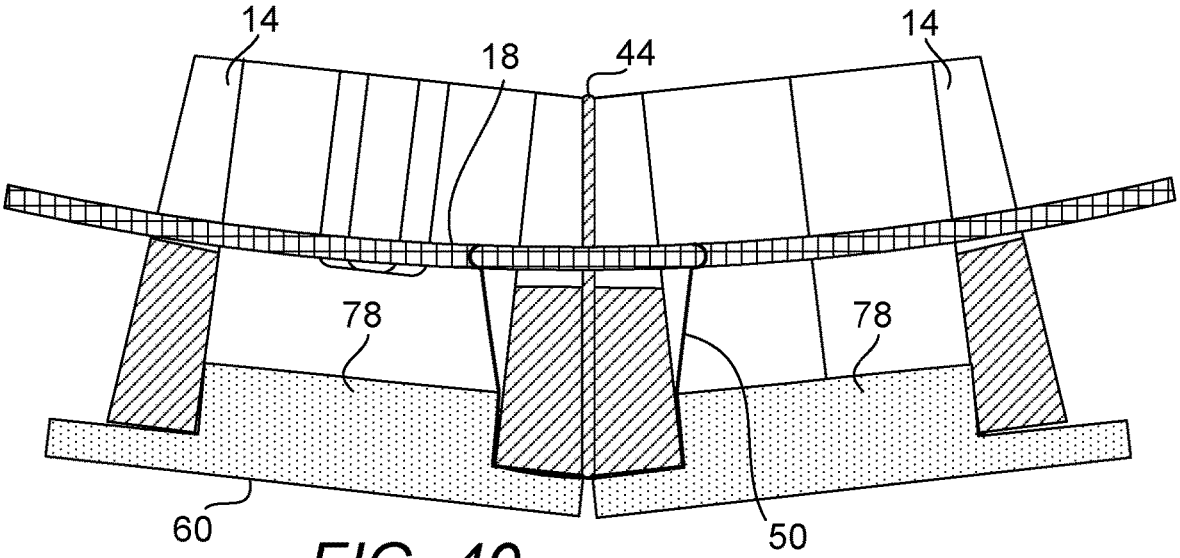
FIG. 40 is a side cross-sectional view of two adjacently disposed blocks.

FIG. 38 is a side cross-sectional view of two adjacently disposed blocks. FIG. 39 is a side cross-sectional view of two adjacently disposed blocks. FIG. 40 is a side cross-sectional view of two adjacently disposed blocks. Here, the blocks are arranged in such a manner that their channels 14 line up such that they may be installed adjacently to one another and yet still receiving a common rebar. It shall be noted that a fastener 62, e.g., wire, ziptie, string, strap, hook and loop-equipped strap, rubber band and snap-equipped strap and the like may be deployed in conjunction with or in place of the bolt 56 to positively secure the rebar 18 or as long as a rebar is capable to be positively secured or the tendency of the rebar to dislodge through the channel within which it is installed is retarded.

Figure 41:
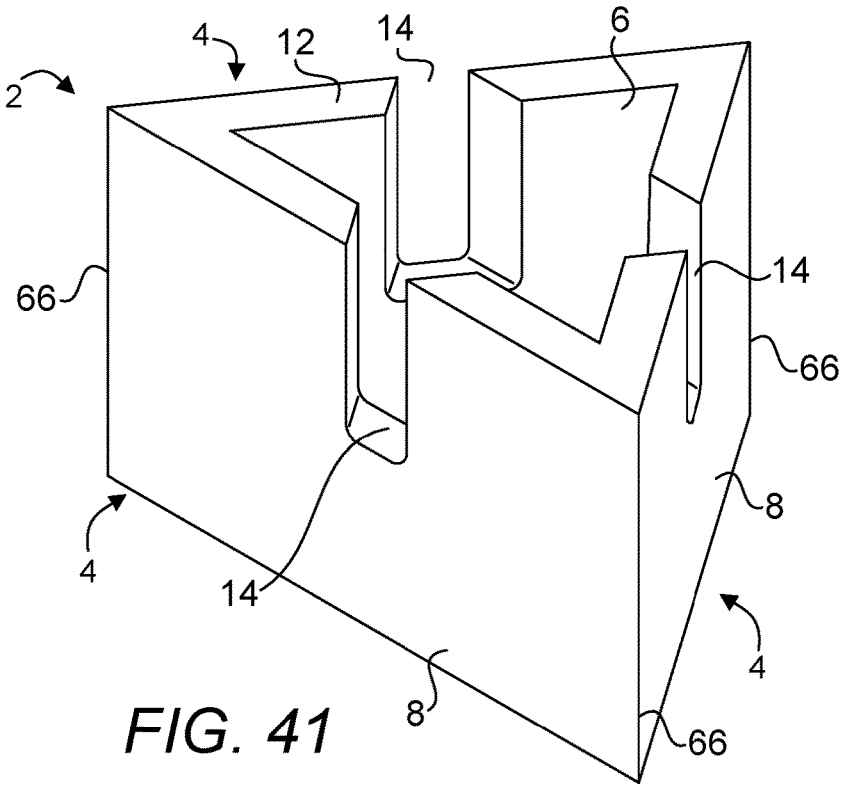
FIG. 41 is a top front perspective view of one embodiment of a block.
Figure 42:
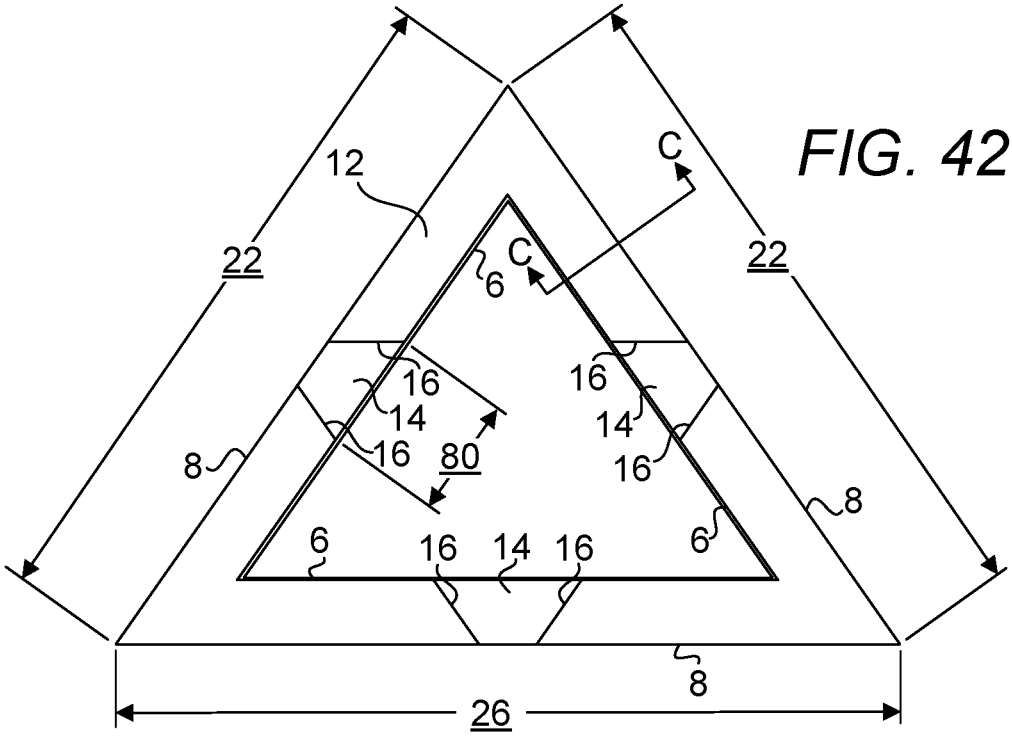
FIG. 42 is a top plan view of the block thereof.
Figure 43:
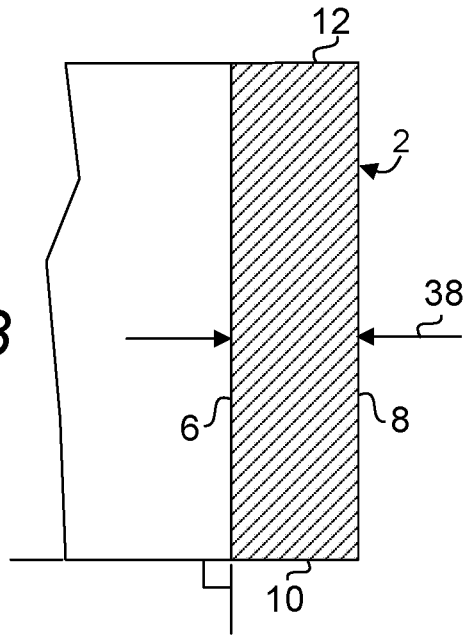
FIG. 43 is a sectional view of a side wall of the block as taken along line C-C of FIG. 42.
Figure 44:
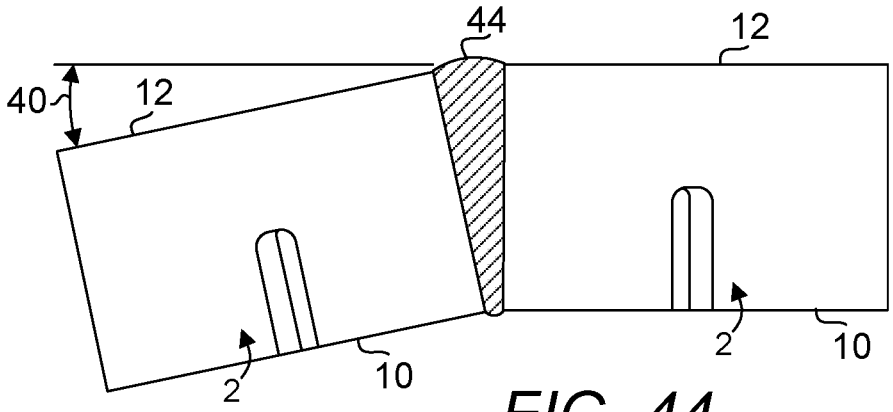
FIG. 44 is a combined unit of two blocks, depicting an angle between blocks that is formed as a result of combining two blocks, each shown in FIGS. 41-42 where mortar has been applied.

FIG. 41 is a top front perspective view of one embodiment of a block. Here, an outside surface 8 is disposed parallel to its corresponding inside surface 6. Note that edges 66 are all parallel to one another. FIG. 42 is a top plan view of the block thereof. FIG. 43 is a sectional view of a side wall of the block as taken along line C-C of FIG. 42. It shall be noted that there is no taper other than one which may be required in construction of the block. In one embodiment, in order to facilitate release of a block from its mold, the mold may be constructed with a taper of about 0.5 degree on each of the outside or inside surfaces of the side walls. FIG. 44 is a combined unit of two blocks 2, depicting an angle between blocks that is formed as a result of combining two blocks, each shown in FIGS. 41-42 where mortar has been applied. It shall be appreciated that, a curved structure may be formed from multiple blocks 2 as a result of adjusting the amount of mortar 44 disposed between two adjacent blocks 2 from the inner surface 10 to the outer surface 12 for each block.

Figure 45:
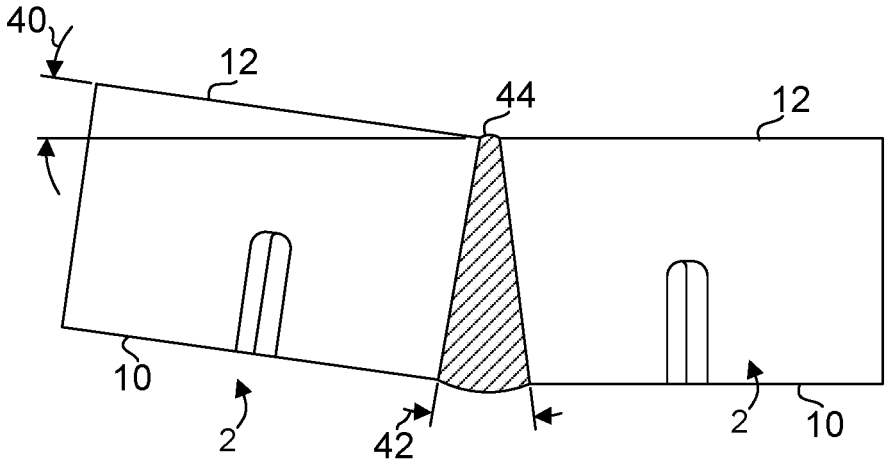
FIG. 45 is a combined unit of two blocks, depicting an angle between blocks that is formed as a result of combining two blocks, each shown in FIGS. 41-42 where mortar has been applied.

FIG. 45 is a combined unit of two blocks, depicting an angle between blocks that is formed as a result of combining two blocks, each shown in FIGS. 41-42 where mortar has been applied. Again, a curved structure may be formed using the same strategy. It shall be noted that, in the case of FIG. 45, the curvature formed of the blocks is opposite to that of the curvature formed in FIG. 44. As the inside and outside walls are parallel, in this embodiment, it is possible to install the blocks in such a manner.

Figure 46:
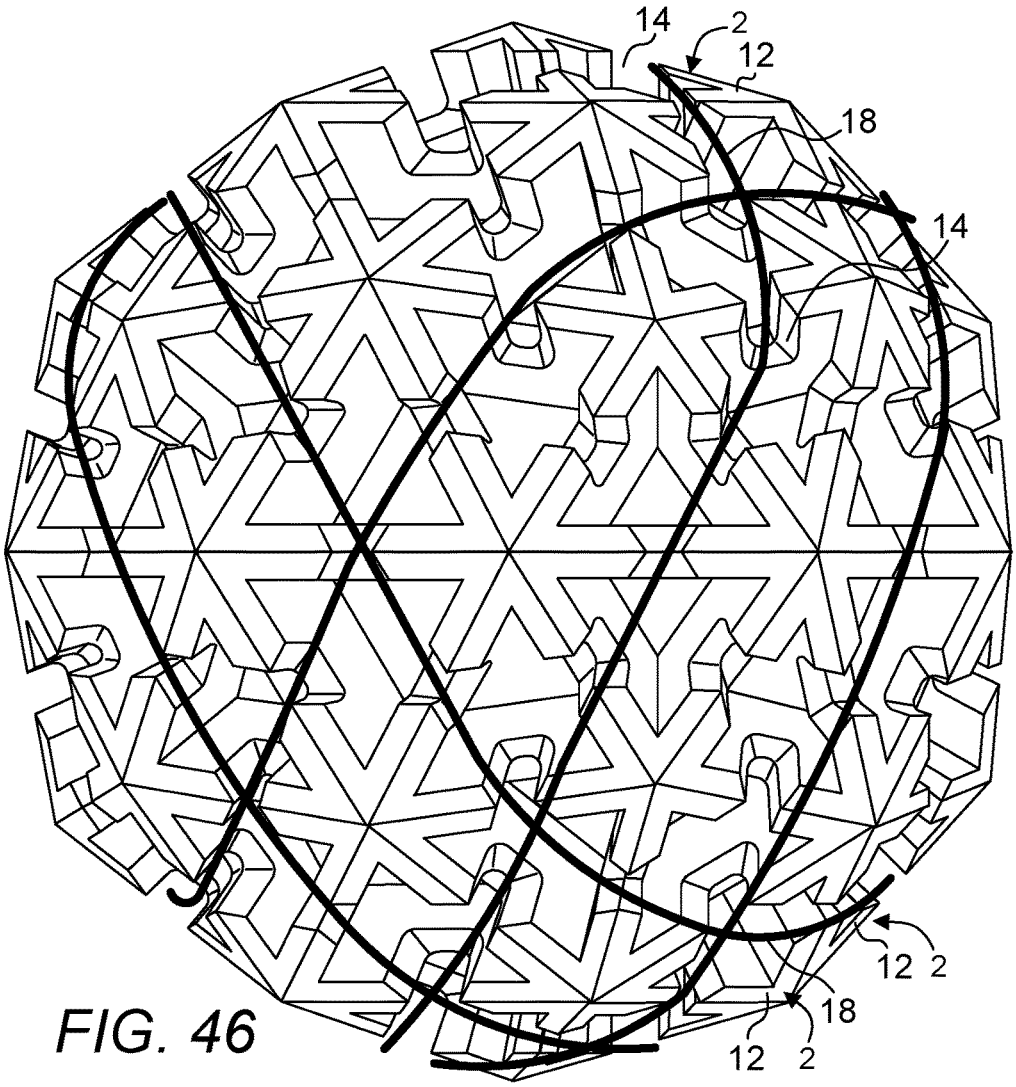
FIG. 46 is a diagram depicting a partial assembly of blocks and a partial rebar framework.

FIG. 46 is a diagram depicting a partial assembly of blocks 2 and a partial rebar framework. It shall be noted that the blocks 2 are arranged in such a manner that the rebar framework essentially surrounds the blocks 2 to positively restrain the "spreading" of the blocks 2. A sphere, e.g., a water tank constructed with such a framework is suitable for containing a liquid that exerts forces on the inner surfaces of the blocks 2.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. An architectural building block system comprising:

(a) three side walls, each having an inside surface and an outside surface, said three side walls cooperate to form a triangular tube, said outside surface of each of said three side walls extending from an inner surface to an outer surface and said inside surface of each of said three walls is disposed substantially at right angle to each of said inner surface and said outer surface; and (b) three channels, each channel disposed on one of said three side walls on said inner surface, wherein said each channel extending from said inside surface to said outside surface of said one of said three side walls, a rebar received by each pair of said three channels and said each channel converges as said each channel extends from said inside surface to said outside surface of said one of said three side walls, wherein at least one said side wall is configured to be positionable so as to mate with a side wall of an adjacently disposed block to form two aligned channels to receive said rebar, whereby curved structures are constructible from a plurality of such blocks to form a dihedral angle between each set of two blocks.

2. The architectural building block system of claim 1, wherein each of said three side walls extends outwardly from said inner surface to said outer surface.

3. The architectural building block system of claim 1, wherein said dihedral angle ranges from about 0.5 degree to about 12 degrees.

4. The architectural building block system of claim 1, wherein each of said three channels comprises a bottom surface that is not parallel to any one of said inner surface and outer surface.

5. The architectural building block system of claim 1, further comprising an anchor configured to secure the rebar to said outer surface, said anchor having a first end configured to be attached to the rebar and a second end configured to be secured to said outer surface.

6. The architectural building block system of claim 1, further comprising an anchor having two ends, a first end of said two ends is configured to be connected to the rebar within an opening of said tube of said block and a second end of said two ends is configured to be connected to the rebar via said outer surface within an opening of a tube of the adjacently disposed block.

7. The architectural building block system of claim 1, further comprising a cladding configured to be disposed on said outer surface of said block, wherein said cladding is configured to plug a cross-sectional area of an opening of said triangular tube.

8. The architectural building block system of claim 7, further comprising an anchor configured to connect said cladding to the rebar to secure the rebar in place.

9. The architectural building block system of claim 7, wherein said cladding comprises an insulating material.

10. An architectural building block system comprising:

(a) three side walls, each having an inside surface and an outside surface, said three side walls cooperate to form a triangular tube, said outside surface of each of said three side walls extending from an inner surface to an outer surface and said inside surface of each of said three walls is disposed substantially at right angle to each of said inner surface and said outer surface; and (b) three channels, each channel disposed on one of said three side walls on said inner surface, wherein said each channel extending from said inside surface to said outside surface of said one of said three side walls and a rebar received by each pair of said three channels, wherein each of said three channels comprises a bottom surface that is not parallel to any one of said inner surface and outer surface, wherein at least one said side wall is configured to be positionable so as to mate with a side wall of an adjacently disposed block to form two aligned channels to receive said rebar, whereby curved structures are constructible from a plurality of such blocks to form a dihedral angle between each set of two blocks.

11. The architectural building block system of claim 10, wherein each of said three side walls extends outwardly from said inner surface to said outer surface.

12. The architectural building block system of claim 10, wherein said each channel converges as said each channel extends from said inside surface to said outside surface of said one of said three side walls.

13. The architectural building block system of claim 10, wherein said dihedral angle ranges from about 0.5 degree to about 12 degrees.

14. The architectural building block system of claim 10, further comprising an anchor configured to secure the rebar to said outer surface, said anchor having a first end configured to be attached to the rebar and a second end configured to be secured to said outer surface.

15. The architectural building block system of claim 10, further comprising an anchor having two ends, a first end of said two ends is configured to be connected to the rebar within an opening of said tube of said block and a second end of said two ends is configured to be connected to the rebar via said outer surface within an opening of a tube of the adjacently disposed block.

16. The architectural building block system of claim 10, further comprising a cladding configured to be disposed on said outer surface of said block, wherein said cladding is configured to plug a cross-sectional area of an opening of said triangular tube.

17. The architectural building block system of claim 16, further comprising an anchor configured to connect said cladding to the rebar to secure the rebar in place.

18. The architectural building block system of claim 16, wherein said cladding comprises an insulating material.

* * * * *